US008215528B2

(12) United States Patent
Matsunaga et al.

(10) Patent No.: US 8,215,528 B2
(45) Date of Patent: Jul. 10, 2012

(54) DRIVE TOOL

(75) Inventors: Yutaka Matsunaga, Anjo (JP); Hidekazu Suda, Anjo (JP); Jiro Oda, Anjo (JP); Kenichi Miyata, Anjo (JP)

(73) Assignee: Makita Corporation, Anjo (JP)

( * ) Notice: Subject to any disclaimer, the term of this patent is extended or adjusted under 35 U.S.C. 154(b) by 259 days.

(21) Appl. No.: 12/733,972

(22) PCT Filed: Sep. 12, 2008

(86) PCT No.: PCT/JP2008/066584

§ 371 (c)(1),
(2), (4) Date: Apr. 1, 2010

(87) PCT Pub. No.: WO2009/044619

PCT Pub. Date: Apr. 9, 2009

(65) Prior Publication Data

US 2010/0237126 A1 Sep. 23, 2010

(30) Foreign Application Priority Data

Oct. 4, 2007 (JP) ..... 2007-260917

(51) Int. Cl.
*B25C 1/14* (2006.01)

(52) U.S. Cl. ..... 227/8; 227/10; 227/130

(58) Field of Classification Search ..... 227/8, 2, 227/130, 10, 136; 123/46 SC
See application file for complete search history.

(56) References Cited

U.S. PATENT DOCUMENTS 5,191,861 A * 3/1993 Kellerman et al. ..... 123/46 SC
5,213,247 A * 5/1993 Gschwend et al. ..... 227/10
5,687,898 A * 11/1997 Toulouse ..... 227/8
6,109,165 A * 8/2000 Velan et al. ..... 92/23
6,382,492 B1 * 5/2002 Moorman et al. ..... 227/8
6,722,548 B2 * 4/2004 Odoni et al. ..... 227/8
6,886,730 B2 * 5/2005 Fujisawa et al. ..... 227/8
7,137,541 B2 * 11/2006 Baskar et al. ..... 227/120

(Continued)

FOREIGN PATENT DOCUMENTS

JP A-9-174460 7/1997

(Continued)

OTHER PUBLICATIONS

International Preliminary Report on Patentability issued for International Application No. PCT/JP2008/066584 on May 4, 2010 (with translation).

(Continued)

*Primary Examiner* — Scott A. Smith

(74) *Attorney, Agent, or Firm* — Oliff & Berridge, PLC

(57) ABSTRACT

A drive tool includes an ejector, a press member, a press detection switch, an operation member, an operation detection switch, a control unit, an operation state detector, and a report unit. The control unit makes the ejector carry out ejection of a fastening tool when the press detection switch and the operation detection switch are turned on. The operation state detector detects a case where the drive tool comes into one of a plurality of kinds of preset operation states which include at least one operation state other than a state of a battery. Report patterns different for each of the plurality of kinds of operation states are set in the report unit. When one of the operation states is detected by the operation state detector, the report unit reports the detection using the report pattern set corresponding to the detected operation state.

10 Claims, 10 Drawing Sheets

U.S. PATENT DOCUMENTS

| | | | | |
|---|---|---|---|---|
| 7,296,719 | B1 * | 11/2007 | Taylor et al. | 227/10 |
| 7,487,898 | B2 * | 2/2009 | Moeller et al. | 227/8 |
| 7,510,105 | B2 * | 3/2009 | Moeller et al. | 227/8 |
| 2005/0156007 | A1 | 7/2005 | Nishikawa et al. | |
| 2008/0314952 | A1 | 12/2008 | Tamura et al. | |

FOREIGN PATENT DOCUMENTS

| | | |
|---|---|---|
| JP | A-9-239674 | 9/1997 |
| JP | A-2000-153469 | 6/2000 |
| JP | A-2002-89853 | 3/2002 |
| JP | A-2005-199397 | 7/2005 |
| JP | A-2006-223028 | 8/2006 |
| JP | A-2007-77720 | 3/2007 |
| JP | A-2007-206652 | 8/2007 |
| JP | A-2007-222989 | 9/2007 |

OTHER PUBLICATIONS

Oct. 7, 2008 International Search Report issued in International Application No. PCT/JP2008/066584.

* cited by examiner

CONTROL CIRCUIT
REGULATOR
MICRO-COMPUTER
CPU
ROM
RAM
COUNTER
EEPROM
CONTROL UNIT
SCR
IGNITION CIRCUIT
Vc
R1
R2
R3
R4
C1
R5
R6
R7
R8
R9
R10
R11
R21
R22
C2
C3
D1
Tr1
Tr2
Tr3
Tr4
Tr5
Tr6
Tr7
L1
L2
11
29
33a
33b
34
(34a)
35
(35a)
51
52
53
54
55
56
57
58
59
60
62
64
65
66
67
68
69
70
71
72
73
74
46
47
48

DRIVE TOOL

TECHNICAL FIELD

The present invention relates to a drive tool for driving a fastening tool such as a nail, a pin, a rivet and others into an object such as a workpiece material.

BACKGROUND ART

There are various types of drive tools like a nail driver and a rivet driver which drive a nail, a pin, a rivet and others into a workpiece material. The drive tools can be classified mainly into air type drive tools which utilize compressed air as the drive source and gas combustion type drive tools which utilize gas combustion pressure as the drive source.

Specifically, in gas combustion type drive tools, unlike air type drive tools, it is not necessary to provide an air source separate from the tool body and an air hose for connecting therebetween. A gas can filled with fuel gas is loaded to the tool body. With the fuel gas from the gas can, a drive source for driving in is generated on the same principle as internal-combustion engine of an automobile (see Patent Document 1, for example).

More particularly, a gas combustion type drive tool includes a cylinder and a piston inside the tool for transmitting to such as a nail a pressure upon gas combustion as a drive power for driving in. Upon driving in, a movable portion (contact arm) at the tool end is at first pressed against a workpiece material (a driven object) to slide the contact arm to the back side of the tool body. Thereby, inside the tool body, a certain amount of fuel gas is supplied from a gas can into a sealed combustion chamber provided in an upper portion of the cylinder. At the same time, a fan provided inside the combustion chamber rotates to mix/stir air and fuel gas inside the combustion chamber.

When a trigger is pulled this state, an igniter provided to face the interior of the combustion chamber sparks to explode the fuel gas inside the combustion chamber. Due to the pressure upon the explosion, the piston is linearly driven to the tool end side. On the tool end side in the piston, a bar-like driver blade for ejecting such as the nail to the workpiece material side is provided in a fixed manner. When the piston is rapidly moved toward the tool end side due to the explosion of the fuel gas, the driver blade as well is rapidly moved toward the tool end side at the same time. Due to the rapid move of the driver blade, such as the nail is pressed/ejected to the workpiece material side and driven into the workpiece material.

As noted above, in a gas combustion type drive tool, a series of driving operation can be done only with the tool body loaded with a gas can. As compared to an air type drive tool, the gas combustion type drive tool has the advantage of being superior in mobility and workability.

Also in the above-described gas combustion type drive tool, a mechanism is generally installed which disables driving of such as a nail unless the trigger is pulled under the condition that the contact arm provided at the tool end is pressed against the workpiece material. A typical example of such mechanism is a structure (mechanism) in which the trigger is unable to be pulled unless the contact arm is pressed against the workpiece material and slid to the back side of the tool body. More particularly, in order to drive in such as a nail, the contact arm has to be pressed against the workpiece material before the trigger is pulled. Such mechanism is adopted (installed) in most gas combustion type drive tools.

Patent Document 1: Unexamined Japanese Patent Publication No. 2005-199397

DISCLOSURE OF THE INVENTION

Problems to be Solved by the Invention

A battery is attached to the above-described drive tool. With power from the battery, various controls inside the tool, such as a control of the igniter and a rotation control of the fan, are performed. In the drive tool configured as such, various kinds of failures may occur, such as a failure in internal electric/electronic parts (e.g., a switch may fall into an always-on state or an always-off state), disconnection of a power line which supplies power to a fan motor for rotating the fan, and so on. If such failures occur, a nail and others may not be driven in normally. Or the tool may become totally inoperable. Thus, a user itself or a repair person has to repair the failed tool.

In a conventional drive tool, when a failure occurs, it is difficult to promptly obtain particular failure information like the detail or cause of the failure, for example, particularly which part of the tool is failed and how, where to repair, and so on. Accordingly, the user or the repair person is usually forced to disassemble the tool upon repair to check every internal mechanism or electric circuit. Repairing requires enormous time and cost.

Also, a drive tool generally necessitates regular maintenance such as for cleaning of the interior of the tool body and for checkup/replacement of consumable parts. Therefore, it is necessary for the user or the tool manager to manage the use state of the tool (such as the number of times used and the number of days used) and perform regular maintenance at appropriate timings.

Practically, however, it is very troublesome for the user side to keep track of when to perform maintenance of the tool. Accordingly, depending on the user, management of time for regular maintenance becomes insufficient. The tool is used for a long term without maintenance and suddenly fails while in use.

As noted above, in the conventional drive tool, it is difficult to grasp the particular detail of failure in the case of failure. It is troublesome to keep track of the time for regular maintenance, resulting in that the tool becomes out of service. To summarize, the conventional drive tool is hard for the user or the repair person to manage/repair/check. In addition to that the repair and management of the tool are time and money consuming, the user is frequently forced to interrupt the work more than necessary.

The present invention has been made in view of the above problems. One object of the invention is to allow the users to particularly and promptly grasp the detail of specific operation states, such as occurrence of failure and arrival of time for regular maintenance, as such states occur.

Means for Solving the Problem

A drive tool according to a first aspect of the present invention which was made to solve the above problems includes an ejector, a press member, a press detection switch, an operation member, an operation detection switch, a control unit, an operation state detector, and a report unit. The ejector ejects a fastening tool to an object to drive the fastening tool into the object. The press member is pressed against the object at one end to be moved. The press detection switch is turned on when the press member is pressed against the object. The operation member is operated when the fastening tool is ejected to the object. The operation detection switch is turned on when the operation member is operated. The control unit receives power supply from a battery to operate and makes the ejector carry out ejection of the fastening tool when the press detection switch and the operation detection switch are turned on. The operation state detector detects a case where the drive tool comes into one of a plurality of kinds of preset operation states which include at least one operation state other than a state of the battery. Report patterns different for each of the plurality of kinds of operation states are set in the report unit. When one of the operation states is detected by the operation state detector, the report unit reports the detection using the report pattern set corresponding to the detected operation state.

In the above configured drive tool, the operation state detector is able to detect the plurality of kinds of operation states. Also, different report patterns are set for each of the plurality of kinds of operation states. When one of the operation states is detected by the operation state detector, the report unit makes a report using the report pattern set corresponding to the detected operation state.

According to the drive tool in the first aspect of the present invention, a user using the drive tool and a repair person (hereinafter, collectively referred to as "the users") are able to particularly and promptly grasp what kind of operation state has occurred in the drive tool from the report pattern reported by the report unit.

The plurality of kinds of operation states may be various operation states assumed to occur in the drive tool. As in a second aspect of the present invention, for example, it is preferable that at least a plurality of kinds of failure states which possibly occur in the drive tool are preset as the plurality of kinds of operation states.

If the plurality of kinds of failure states are set as the operation states detected by the operation state detector as above, the report unit, when one of the set failure states occurs, makes a report using the report pattern set corresponding to the failure state. Accordingly, the users are able to particularly and promptly grasp what kind of failure has occurred by looking at the report pattern.

There are various driving powers for driving a fastening tool in the drive tool according to the second aspect of the present invention. For example, air pressure may be utilized as driving power, or gas combustion pressure may be utilized as driving power. Especially, the drive tool utilizing gas combustion pressure may be configured, for example, as in a third aspect of the present invention.

More particularly, the invention according to the third aspect of the present invention is the drive tool according to the second aspect in which the ejector includes a combustion chamber, a fan, a motor, an igniter, and a power transmitter. When the press member is moved, fuel gas is supplied into the combustion chamber. The fan stirs the fuel gas supplied into the combustion chamber inside the combustion chamber. The motor receives power supply from the battery to operate and rotates the fan when the press detection switch is turned on. The igniter receives power supply from the battery to operate and ignites and burns the fuel gas inside the combustion chamber when the operation detection switch is turned on. The power transmitter transmits to the fastening tool a pressure generated when the fuel gas is burned by the igniter as a power for ejection. As one of the failure states, a first failure state is set which indicates that electrical connection is not normal between the motor and a connected object electrically connected to the motor. The operation state detector determines whether or not the electrical connection is normal between the motor and the connected object, and, based on a determination result, detects the first failure state.

In the above configured drive tool, the fuel gas supplied into the combustion chamber is stirred by the fan. Thereby, favorable combustion of the fuel gas is facilitated. Assuming that abnormality occurs to the electrical connection between the motor and the connected object for some reason and the fan no longer rotates normally, ignition by the igniter has to be performed under the condition that the fuel gas inside the combustion chamber is not sufficiently stirred. As a result, incomplete combustion of the fuel gas occurs. Adverse effects occur such that the fastening tool may not be able to be sufficiently driven in, and the combustion chamber and the igniter may get filthy.

In the above configured drive tool, when the first failure state occurs in which electrical connection is not normal between the motor and the connected object, the first failure state is detected, and the report unit makes a report using the report pattern set corresponding to the first failure state. Accordingly, the users can promptly recognize occurrence of the first failure state. The above-described adverse effects caused by the fan not normally rotating can be inhibited.

The above configured drive tool (the third aspect of the present invention) can be configured as follows, for example as in a fourth aspect of the present invention, if the igniter is configured such that the power supply from the battery is stopped when the operation detection switch is not turned on. A second failure state is set, as one of the failure states, which indicates that the power from the battery is supplied to the igniter when the operation detection switch is not turned on. The operation state detector detects the second failure state based on a state of the operation detection switch and a state of power supply from the battery to the igniter.

In other words, a state is not normal in which a battery power is supplied to the igniter although the operation detection switch is not turned on. Thus, such state can be made detectable as the second failure state and, if detected, the report unit makes a report using the report pattern set corresponding to the second failure state. Accordingly, the users can promptly recognize occurrence of the second failure state. The adverse effects which may possibly occur due to the second failure state (for example, unnecessary operation of the igniter) can be inhibited.

In one of the above-described drive tools according to the second to the fourth aspects of the present invention, the press detection switch may remain turned on for reasons such that the press member is left moved and never returns, the press detection switch is melted and stuck, an so on. Also, for example, the operation detection switch may remain turned on by the same reasons as the above-described press detection switch.

Therefore, one of the drive tools according to the second to the fourth aspects may be configured as follows, for example as in a fifth aspect of the present invention. At least one of a third failure state and a fourth failure state may be set as the failure state. The third failure state indicates that the press detection switch is already turned on when power supply from the battery to the control unit is started. The fourth failure state indicates that the operation detection switch is already turned on when power supply from the battery to the control unit is started. The operation state detector detects at least one of the set third failure state and the set fourth failure state based on one of a state of the press detection switch and a state of the operation detection switch immediately after power supply from the battery to the control unit is started.

According to the above configured drive tool, when power supply from the battery to the control unit is started (i.e., when the drive tool is started to be actuated), at least one of the third failure state or the fourth failure state is detected. The users can immediately recognize presence/absence of the respective failure states. Thus, in case that one of the failure states is detected at the start of the operation, the users can attend to the failure right away.

Even if the drive tool is normal at the time of starting power supply from the battery to the control unit, the press detection switch may remain turned on for some reason while in use by the users.

One of the drive tools according to the second to the fifth aspects of the present invention may be configured as follows, for example as in a sixth aspect of the present invention. A fifth failure state may be set as one of the failure states which indicates that the press detection switch has been turned on for a period of time equal to or more than a predetermined period of time. The operation state detector includes a timer that times the period during which the press detection switch is turned on, and detects the fifth failure state based on a timing result by the timer.

According to the above configured drive tool, the users can immediately recognize occurrence of the fifth failure state when the fifth state occurs, after the power is supplied from the battery to the control unit and the operation is started.

The drive tool according to a seventh aspect of the present invention is one of the drive tools according to the second to the sixth aspects of the present invention which includes an interlock mechanism. The interlock mechanism is a mechanism which disables operation of the operation member unless the press member is moved and which, after the operation member is operated in a state in which the press member is moved, keeps the moved press member from returning to its original position unless the operation member returns to its original state before being operated. As one of the failure states, a sixth failure state is set which indicates a state in which the operation detection switch is turned on when the press detection switch is turned off. The operation state detector detects the sixth failure state based on the states of the press detection switch and the operation detection switch.

If the interlock mechanism is normal, a state cannot occur in which the operation detection switch is turned on although the press detection switch is turned off. Such state can occur in the case of some abnormality in the interlock mechanism.

The drive tool according to the seventh aspect of the present invention is configured to be able to detect the above-described state as the sixth failure state. Accordingly, the users can immediately recognize occurrence of the sixth failure state which can occur in case that abnormality occurs to the interlock mechanism.

The drive tool according to an eighth aspect of the present invention is one of the drive tools according to the first to the seventh aspects of the present invention in which at least a check required state is preset as the operation state. The check required state is a state in which the time to check the drive tool has arrived.

In this manner, if the check required state is set as the operation state detected by the operation state detector, the users can recognize for certain that the time to check the drive tool has arrived through the report pattern by the report unit.

In this case, there are various manners on particularly how the operation state detector detects the check required state. For example, the check required stated can be detected as in a ninth aspect of the present invention. More particularly, the operation state detector includes an ejection times counter and an ejection times determiner. The ejection times counter counts a number of times of ejection of the fastening tool by the ejector. The ejection times determiner determines whether or not the number counted by the ejection times counter exceeds a predetermined ejection times determining threshold. When it is determined by the ejection times determiner that the counted number exceeds the ejection times determining threshold, the operation state detector detects the check required state.

In this manner, through detection of the check required state for the time to check based on ejection times, arrival of the time to check can be accurately reported to the users.

The drive tool according to a tenth aspect of the present invention is one of the drive tools according to the first to the ninth aspects of the present invention in which the report unit includes at least one light emitter that emits light of a certain color. Reporting is performed by making the light emitter emit light using different emitting patterns per each of the plurality of kinds of operation states as the report patterns.

In other words, reporting when the operation state is detected by the operation state detector is performed by light emission by the light emitter (i.e., visual reporting). Thus, the users can easily grasp the kind of failure state by looking at the light emitting pattern.

EXPLANATION OF REFERENTIAL NUMERALS

1, 70 . . . gas nailer, 3 . . . housing, 4 . . . magazine, 5 . . . handle, 6 . . . contact arm, 7 . . . trigger, 7*a* . . . cutout, 11 . . . battery, 12 . . . ejector, 15 . . . cylinder, 16 . . . piston, 17 . . . driver blade, 23 . . . combustion chamber frame, 27 . . . combustion chamber, 28 . . . head cover, 29 . . . fan motor, 30 . . . fan, 31 . . . fuel gas supply path, 32 . . . fuel gas jet opening, 33 . . . ignition plug, 33*a* . . . ground side electrode, 33*b* . . . high voltage side electrode, 34 . . . contact arm SW, 34*a* . . . movable contact, 35 . . . trigger SW, 35*a* . . . movable contact, 36 . . . switch contact wall, 37 . . . switch contact piece, 38 . . . lock material, 39 . . . lock hole, 40, 71, control circuit, 41 . . . substrate, 42 . . . high voltage power line, 43, 44 . . . substrate side connector, 45 . . . indication lamp, 46, 47, 48 . . . LED, 51 . . . contact arm SW input circuit, 52 . . . trigger SW input circuit, 53 . . . battery voltage detection circuit, 54 . . . fan motor operation circuit, 55 . . . motor connection detection circuit, 56 . . . output ignition power supply circuit, 56 . . . ignition power supply circuit, 57 . . . ignition power detection circuit, 58 . . . ignition control circuit, 59 . . . ignition circuit, 60 . . . indication circuit, 61, 74 . . . microcomputer, 62 . . . regulator, 64 . . . control unit, 65 . . . ignition coil, 66 . . . CPU, 67 . . . ROM, 68 . . . RAM, 69 . . . counter, 72 . . . charging voltage detection circuit, 73 . . . EEPROM, 91, 92 . . . board-in connector, 93 . . . lead wire, 94 . . . relay side connector, 103 . . . connected target side connector, 104 . . . power line, C2 . . . charging capacitor, SCR . . . discharging thyristor, W . . . workpiece material

BEST MODE TO CARRY OUT THE INVENTION

Preferred embodiments of the present invention will be described hereinafter based on drawings.

First Embodiment (1) Overall Structure of Gas Nailer

Figure 1:
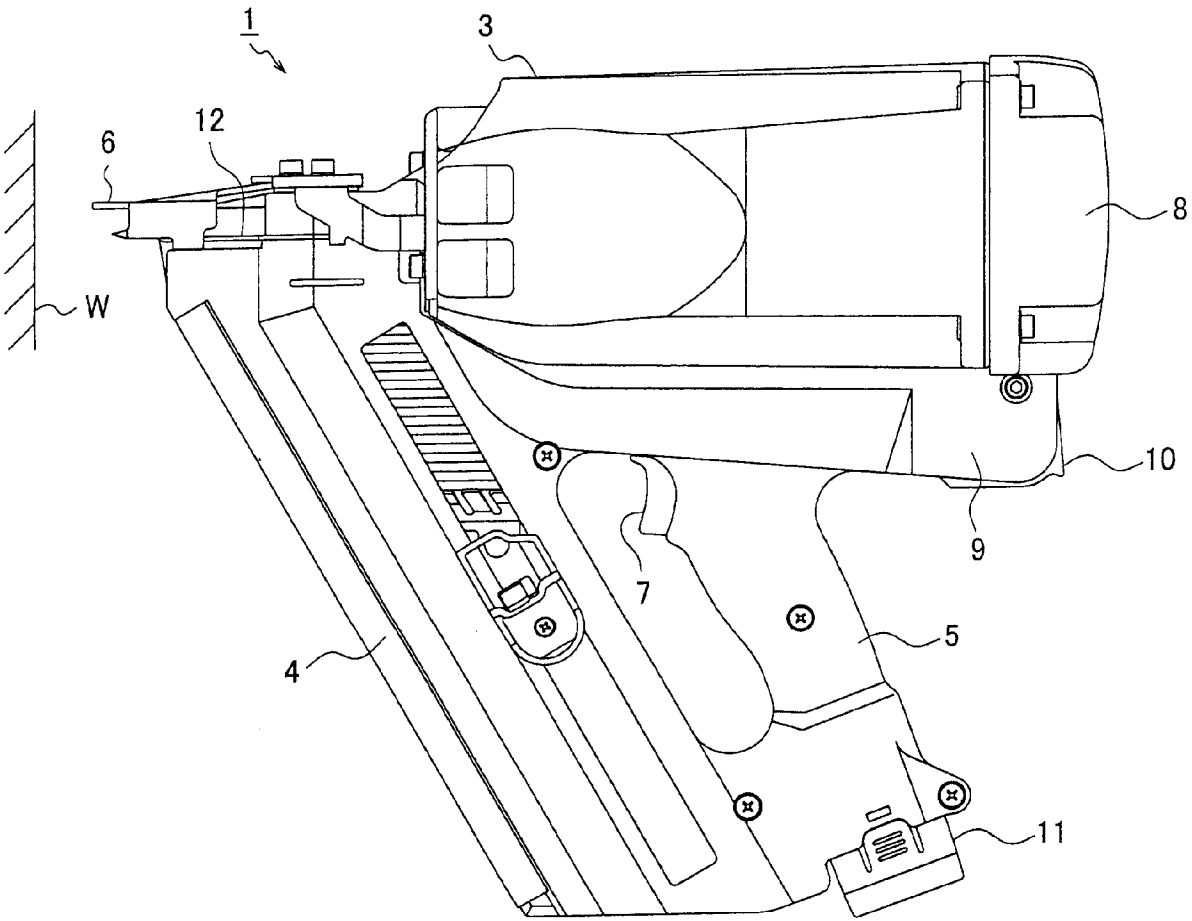
FIG. 1 is a side view of a gas nailer according to first and second embodiments.
Figure 2:
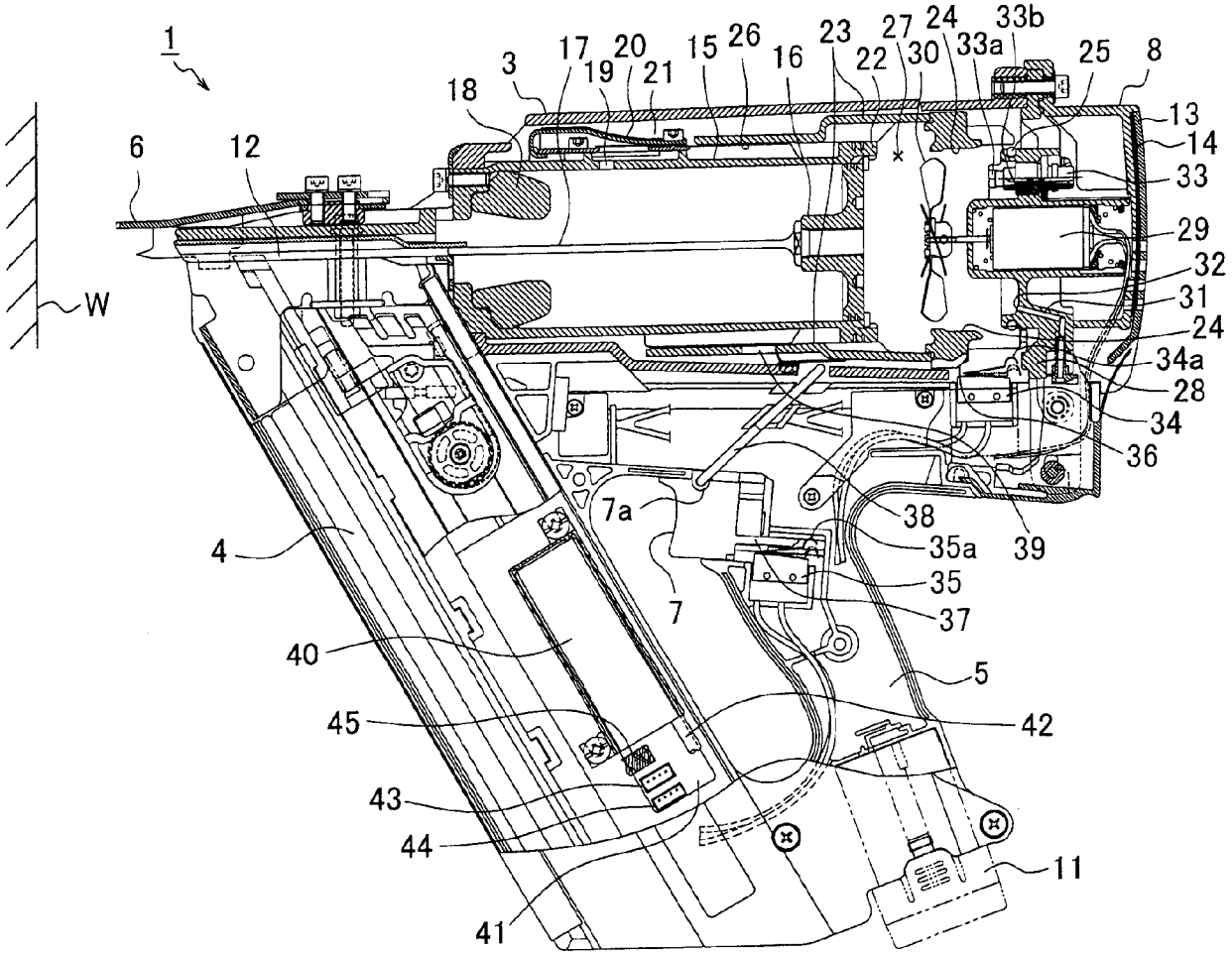
FIG. 2 is a cross sectional view of the gas nailer according to the first and second embodiments.

First of all, an overall structure of a gas combustion type nail driver (corresponding to a (combustion type) drive tool of the present invention; referred to as a "gas nailer" hereinafter) 1 of an embodiment to which the present invention is applied will be described based on FIGS. 1 and 2. FIG. 1 is a side view of the gas nailer 1 of the present embodiment. FIG. 2 is a cross sectional view of the gas nailer 1.

As shown in FIG. 1, the gas nailer 1 mainly includes a housing 3, a magazine 4, a handle 5, a contact arm 6, a trigger 7, a head cap 8 and a fuel gas can loader 9, as its external form. In the description hereinafter, a direction viewed from the housing 3 toward a front en (the contact arm 6) side in the gas nailer 1 (left direction in the drawing sheets of FIGS. 1 and 2) is defined as "forward". A direction viewed from the housing 3 toward a back end (the head cap 8) side in the gas nailer 1 (right direction in the drawing sheets of FIGS. 1 and 2) is defined as "backward". A direction viewed from the housing 3 toward the handle 5 side (down direction in the drawing sheets of FIGS. 1 and 2) is defined as "downward". A direction viewed from the housing 3 toward a side opposite to the handle 5 (up direction in the drawing sheets of FIGS. 1 and 2) is defined as "upward".

Into the fuel gas can loader 9 provided under the housing 3, a cylindrical fuel gas can (not shown) is detachably loaded which is filled with fuel gas such as a flammable liquefied gas. On the backward side of the fuel gas can loader 9, a gas can cap 10 is provided. When the gas can cap 10 is opened, the fuel gas can loader 9 opens backward. The fuel gas can is inserted from the opening to be loaded.

The magazine 4 is attached to the forward side of the housing 3. The magazine 4 stores a plurality of nails contacted to each other (corresponding to a fastening tool of the present invention), and arranges the nail to be driven in to face an ejector 12. A battery 11 is detachably attached to a lower end of the handle 5. The battery 11 is a rechargeable battery which is repeatedly chargeable, such as a nickel hydride rechargeable battery or a lithium ion rechargeable battery. Power necessary for various controls such as ignition control and failure detection in the gas nailer 1 (details will be described later) is supplied from the battery 11.

When driving a nail into a workpiece material W as an object, the user grips the handle 5 of the gas nailer 1 to press the contact arm 6 against the workpiece material W, and pulls the trigger 7 in that state. Then, the fuel gas explodes inside the housing 3. The pressure of the explosion becomes a driving power and a nail is ejected from the ejector 12 to be driven into the workpiece material W. The details of the operation upon driving in a nail will be described later.

Now, based on FIG. 2, the detailed structure of the gas nailer 1 will be more particularly described. As shown in FIG. 2, a cap grill 13 having a lot of vent openings is attached to a back end surface side of the head cap 8 provided on the backward side of the housing 3. From the vent openings through an air filter 14, fresh air can be taken into the housing 3.

Inside the housing 3, a cylinder 15 and a head cover 28 are provided secured to the housing 3. Inside the cylinder 15, a piston 16 and a bar-like driver blade 17 are provided. The piston 16 is slidably arranged in an anteroposterior direction inside the cylinder 15 (i.e., axial direction of the cylinder 15). The driver blade 17 is connected to the piston 16 in an integrated manner. A front end of the driver blade 17 is inserted to the ejector 12 for ejecting a nail forward. The driver blade 17 is able to slide in an anteroposterior direction inside the ejector 12 with the slide of the piston 16.

On the front end side inside the cylinder 15, a bumper 18 is provided which absorbs and attenuates an impact of the piston 16 driven at high speed toward the front end by the explosion of the fuel gas and receives the piston 16. Moreover, the cylinder 15 includes a vent hole 19 and a check valve 20. The vent hole 19 communicates inside of a bore of the cylinder 15 with an interior space 21 of the housing 3. The check valve 20 opens/closes the vent hole 19. The check valve 20 is configured as a one-way valve which allows air inside the bore of the cylinder 15 to flow out to the interior space 21 on one hand and disallows air in the interior space 21 to flow into the bore of the cylinder 15 on the other hand.

A flange 22 is formed at a hack end of the cylinder 15. Inside the housing 3, a cylindrical combustion chamber frame 23 is arranged in such a manner as to cover the overall outer peripheral surface of the back end of the cylinder 15 including the flange 22. The combustion chamber frame 23 is able to move in an anteroposterior direction along the cylinder 15 (guided by the cylinder 15). Also, the combustion chamber frame 23 is connected to the contact arm 6 provided forward of the housing 3, and moves with the contact arm 6 in an integrated manner.

The contact arm 6 is biased toward the front end side (forward) by a not shown spring at normal times (when the front end of the contact arm 6 is open without touching the workpiece material W and others). Thus, the combustion chamber frame 23 connected to the contact arm 6 is also in a state stopped at a position moved forward at normal times. FIG. 2 shows the state at normal times.

In this state (the state at normal times), as the gas nailer 1 is pressed against the workpiece material W (i.e., the contact arm 6 is pressed against the workpiece material W), the contact arm 6 is moved backward against a biasing force of the spring and the combustion chamber frame 23 connected to the contact arm 6 also slides backward in conjunction with the backward move of the contact arm 6.

When the combustion chamber frame 23 slides backward in conjunction with the backward move of the contact arm 6 as such, a back end side inner peripheral surface 24, which is a surface of the back end side region in an inner peripheral surface of the combustion chamber frame 23, is brought into contact with the head cover 28. At this time, an O ring 25 seals between the back end side inner peripheral surface 24 and the head cover 28. At the same time, a front end side inner peripheral surface 26, which is a surface of the front end side region in the inner peripheral surface of the combustion chamber frame 23, also adheres to an outer peripheral surface of the flange 22. As a result, a combustion chamber 27 is formed as a space sealed by the combustion chamber frame 23, the head cover 28 and the piston 16.

Inside the combustion chamber 27, a fan 30 is provided which is rotationally driven by a fan motor 29 provided in the head cover 28. Other than the fan motor 29, the head cover 28 includes a fuel gas supply path 31, a fuel gas jet opening 32, and an ignition plug 33. The fuel gas supply path 31 leads the fuel gas from the fuel gas can to the combustion chamber 27. The fuel gas supplied through the fuel gas supply path 31 is jetted into the combustion chamber 27 through the fuel gas jet opening 32. The ignition plug 33 ignites the fuel gas jetted into the combustion chamber 27 and explodes the fuel gas. The ignition plug 33 is provided such that a ground side electrode 33*a* having a ground potential and a high voltage side electrode 33*b* having a high potential face the interior of the combustion chamber 27 at a certain interval (air gap).

Also inside the body of the gas nailer 1, a contact arm switch (referred to as a "contact arm SW", hereinafter) 34 and a trigger switch (referred to as a "trigger SW", hereinafter) 35 are provided. The contact arm SW 34 electrically detects the state when the contact arm 6 is pressed against the workpiece material W and moved backward (i.e., the sealed combustion chamber 27 is formed). The trigger switch electrically detects the state when the trigger 7 is pulled.

The contact arm SW 34 is provided at a lower backward portion inside the housing 3 as shown in FIG. 2. The contact arm SW 34 includes a movable contact 34*a* which is a conductor made of metal or the like. Under such constitution, when the contact arm 6 is pressed against the workpiece material W and moved backward, the combustion chamber frame 23 connected to the contact arm 6 also moves (slides) backward as previously noted. Then, a switch contact wall 36 formed on a back end side outer peripheral portion of the combustion chamber frame 23 moves backward, and then comes into contact with the movable contact 34*a* of the contact arm SW 34 to press the movable contact 34*a* downward. Thereby the contact arm SW 34 is turned on.

The trigger SW 35 is provided backward of the trigger 7 inside the handle 5 and includes a movable contact 35*a* which is a conductor made of metal or the like. Under such constitution, when the trigger 7 is pulled by the user, a switch contact piece 37 formed at a back portion of the trigger 7 to protrude backward is also moved backward. Then, the moved switch contact piece 37 comes into contact with the movable contact 35*a* of the trigger SW 35 to press the movable contact 35*a* downward. Thereby, the trigger SW 35 is turned on.

Also in the gas nailer 1 of the present embodiment, a mechanism (hereinafter, referred to as an "interlock") is installed which disallows the user to pull the trigger 7 unless the contact arm 6 is pressed against the workpiece material W and slid backward, and also disallows the contact arm 6 to return to its original position (at normal times) unless the trigger 7 is returned after the contact arm 6 is pressed against the workpiece material W and the trigger 7 is pulled.

More particularly, at normal times, a front end (lower end) of a lock member 38 is engaged with a cutout 7*a* formed in an upper portion of the trigger 7. Even if the user attempts to pull the trigger 7, the backward move of the trigger 7 is blocked by the lock member 38 and the trigger 7 is unable to be pulled. When the contact arm 6 is pressed against the workpiece material W and slid backward, the combustion chamber frame 23 also moves backward simultaneously. Thereby, the lock member 38 moves upward and the lower end comes off the cutout 7*a*, allowing the trigger 7 to be pulled.

When the contact arm 6 is pressed against the workpiece material W and the trigger 7 is pulled, an upper end of the lock member 38 is inserted through a lock opening 39 formed in a lower portion of the combustion chamber frame 23. Therefore, even if the contact arm 6 is separated from the workpiece material W in that state (in a state in which the trigger 7 is pulled), forward move of the combustion chamber frame 23 is blocked by the lock member 38. Thus, the contact arm 6 is also unable to move to the front end side (i.e., return to the state at normal times). On the other hand, when the trigger 7 is returned, the lower end of the lock member 38 is again engaged with the cutout 7*a* of the trigger 7 and the upper end comes off the lock opening 39. Hence, when the contact arm 6 is separated from the workpiece material W thereafter, the combustion chamber frame 23 and the contact arm 6 connected thereto move forward to return to their original states (at normal times).

The magazine 4 stores a plurality of nails as previously noted, and also stores a control circuit 40 as a control unit. The control circuit 40 receives power supply from the battery 11 to operate, and performs various controls in the gas nailer 1, such as ignition control and failure detection. The control circuit 40 includes a substrate 41 on which a circuit is formed for performing various controls.

High voltage current is supplied from the control circuit 40 to the ignition plug 33 via a high voltage power line 42. Other portions (the battery 11, the fan motor 29, the respective SWs 34*a* and 37*a*, and so on) inside the gas nailer 1 are electrically connected to the control circuit 40 via two substrate side connectors 43 and 44 provided at an end of the substrate 41.

Moreover, on the substrate 41, an indication lamp 45 is provided for reporting various operation states of the gas nailer 1 to the outside. The indication lamp 45 includes three LEDs 46, 47 and 48 (see FIG. 3), as described later, which are provided to face the outside of the gas nailer 1. More particularly, the indication lamp 45 is provided in such a manner as to protrude from a left side surface of the magazine 4 when the users view the gas nailer 1 from the backward side, and such that the users can view the three LEDs 46, 47 and 48 from the backward side of the gas nailer 1 in the protruding portion.

(2) Configuration of Control Circuit 40

Figure 3:
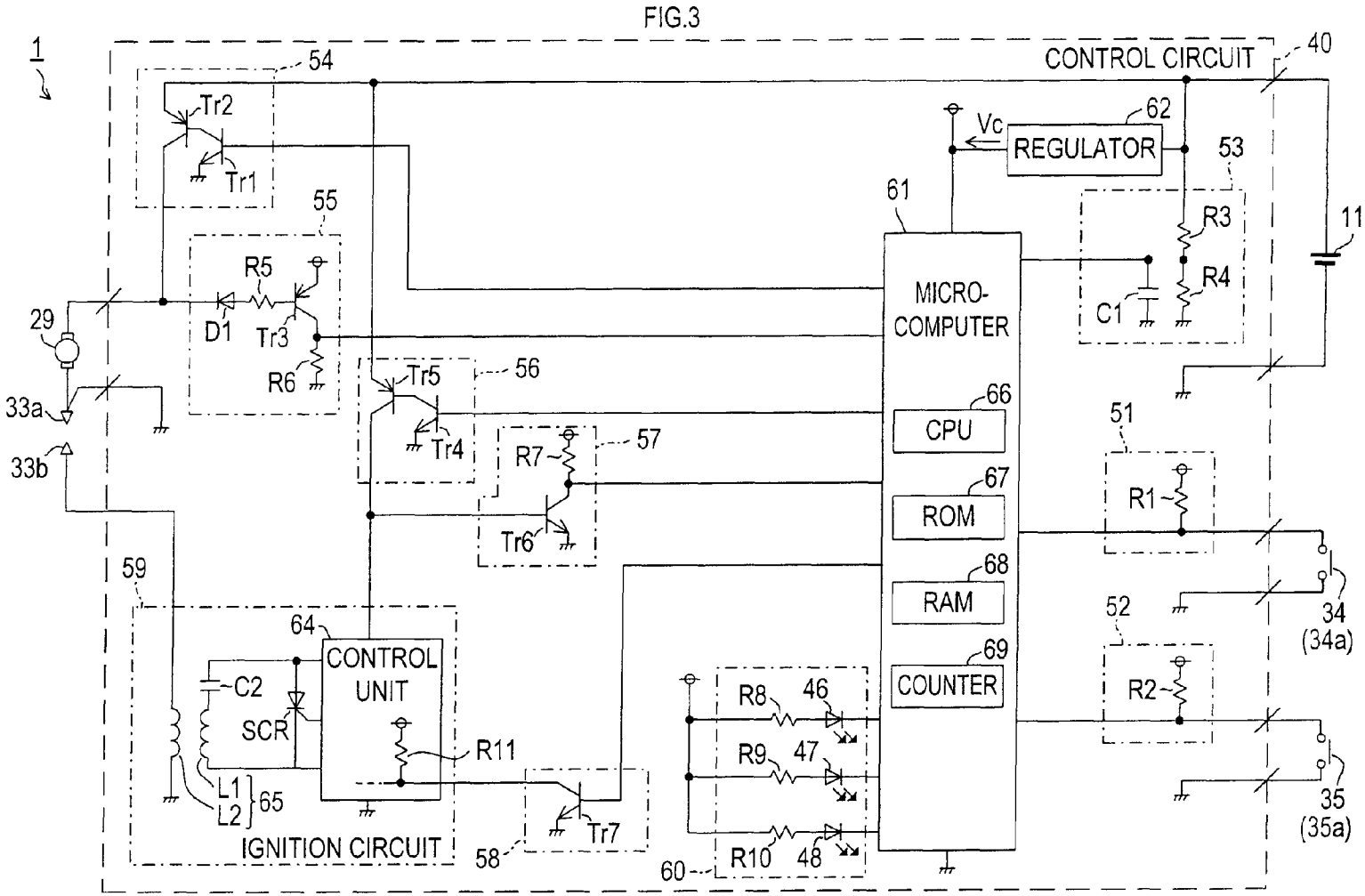
FIG. 3 is a circuit diagram showing a control circuit provided in the gas nailer according to the first embodiment.

Now, electrical configuration of the control circuit 40 provided in the gas nailer 1 according to the present embodiment will be described based on FIG. 3. FIG. 3 is a circuit diagram of the control circuit 40.

As shown in FIG. 3, the control circuit 40 performs various controls in the gas nailer 1, such as ignition control, failure detection, and so on. The control circuit 40 mainly includes a microcomputer 61, a regulator 62, a contact arm SW input circuit 51, a trigger SW input circuit 52, a battery voltage detection circuit 53, a fan motor operation circuit 54, a motor connection detection circuit 55, an ignition power supply circuit 56, an ignition power detection circuit 57, an ignition control circuit 58, an ignition circuit 59, and an indication circuit 60.

The microcomputer 61 manages the overall controls executed by the control circuit 40, such as ignition control, failure detection, and so on. The microcomputer 61 has a known hardware configuration which includes a CPU 66, a ROM 67, a RAM 68, and a counter 69. The CPU 66 executes various control programs to perform associated various control processes. The ROM 67 stores the various control programs executed by the CPU 66. The RAM 68 temporarily stores data, and so on, produced during the execution of various computing processes by the CPU 66.

The microcomputer 61 operates when the battery 11 is attached to the gas nailer 1 and power is supplied from the battery 11 to the control circuit 40 (in detail, when a constant voltage power is supplied from the regulator 62 to the respective portions inside the control circuit 40). The microcomputer 61 executes various control processes while transmitting/receiving signals to/from the respective circuits inside the control circuits 40 according to the various control programs stored in the ROM 67.

The regulator 62 generates a power having a predetermined constant voltage (Vc) from the power from the battery 11. The generated constant voltage power is supplied not only to the microcomputer 61 but also to the respective circuits inside the control circuit 40 which require the constant voltage Vc as their power.

The contact arm SW input circuit 51 detects the state of the contact arm SW 34 (see FIG. 2 for details) and outputs to the microcomputer 61 a signal (contact arm SW signal) corresponding to the detected state. As shown in the figure, one end of the movable contact 34*a* of the contact arm SW 34 is grounded, and the other end is connected to the regulator 62 side via a pull-up resistor R1 inside the contact arm SW input circuit 51.

Accordingly, when the contact arm SW 34 is turned off, the contact arm SW signal of H level (High level) is supplied from the contact arm SW input circuit 51 to the microcomputer 61. On the other hand, when the contact arm 6 is pressed against the workpiece material W and the contact arm SW 34 is turned on, the contact arm SW signal from the contact arm SW input circuit 51 to the microcomputer 61 becomes L level (Low level). Thus, the microcomputer 61 can grasp the state (on or off) of the contact arm SW 34 based on the contact arm SW signal from the contact arm SW input circuit 51.

The trigger SW input circuit 52 detects the state of the trigger SW 35 (see FIG. 2 for details) and outputs a signal (trigger SW signal) corresponding to the detected state to the microcomputer 61. As shown in the figure, one end of the movable contact 35*a* of the trigger SW 35 is grounded, and the other end is connected to the regulator 62 side via a pull-up resistor R2 inside the trigger SW input circuit 52.

Accordingly, when the trigger SW 35 is turned off, the trigger SW signal of H level is supplied from the trigger SW input circuit 52 to the microcomputer 61. On the other hand, when the trigger 7 is pulled and the trigger SW 35 is turned on, the trigger SW signal from the trigger SW input circuit 52 to the microcomputer 61 becomes L level. Thus, the microcomputer 61 can grasp the state (on or off) of the trigger SW 35 based on the trigger SW signal from the trigger SW input circuit 52.

The battery voltage detection circuit 53 is a circuit for detecting a voltage value of the battery 11. The battery voltage detection circuit 53 includes two voltage dividing resistors R3 and R4, and a capacitor C1. The voltage dividing resistors R3 and R4 divide the battery voltage (voltage of the battery 11) at a predetermined voltage dividing ratio. The capacitor C1 absorbs fluctuation of a voltage dividing value divided by the voltage dividing resistors R3 and R4 and supplies the stabilized voltage dividing value (analog battery voltage signal) to the microcomputer 61. With such configuration, the battery voltage signal having a value corresponding to the battery voltage value is supplied from the battery voltage detection circuit 53 to the microcomputer 61. The microcomputer 61 is able to determine whether the battery voltage is normal or insufficient based on the battery voltage signal.

The fan motor operation circuit 54 is a circuit for supplying/interrupting power from the battery 11 to the fan motor 29. The fan motor operation circuit 54 includes a control transistor (NPN type bipolar transistor) Tr1 and a current-carrying transistor (PNP type bipolar transistor) Tr2. A base of the control transistor Tr1 is connected to a prescribed port of the microcomputer 61. An emitter of the control transistor Tr1 is grounded. A collector of the control transistor Tr1 is connected to a base of the current-carrying transistor Tr2. The battery voltage is supplied to an emitter of the current-carrying transistor Tr2. A collector of the current-carrying transistor Tr2 is connected to the fan motor 29.

With the above-described configuration, when a motor driving signal of L level is supplied from the microcomputer 61 to the fan motor operation circuit 54, both the transistors Tr1 and Tr2 are turned off. Power is not supplied to the fan motor 29 and the fan motor 29 is stopped. On the other hand, when the motor driving signal of H level is supplied from the microcomputer 61 to the fan motor operation circuit 54, the control transistor Tr1 is turned on and thereby the current-carrying transistor Tr2 is also turned on. As a result, power is supplied from the battery 11 to the fan motor 29, and the fan motor 29 rotates (and the fan 30 rotates).

The motor connection detection circuit 55 is a circuit for detecting whether or not the fan motor 29 and the control circuit 40 are electrically connected normally, that is, for example, whether or not a power line is interrupted which electrically connects the fan motor 29 and the control circuit 40. The motor connection detection circuit 55 includes a detection transistor (PNP type bipolar transistor) Tr3. A base of the detection transistor Tr3 is connected to an anode of a diode D1 for backflow prevention via a resistor R5. An emitter of the detection transistor Tr3 is connected to the regulator 62. A collector of the detection transistor Tr3 is connected to a prescribed port of the microcomputer 61 and grounded via a resistor R6. A cathode of the diode D1 is connected to the fan motor 29. A voltage of the collector of the detection transistor Tr3 is supplied to the microcomputer 61 as a motor connection detection signal of H level or L level.

The fan motor 29 can be regarded as a coil electrically. A resistance value of the fan motor 29 is zero galvanically. Accordingly, when the fan motor 29 is connected to the control circuit 40 normally and is stopped, a minute electric current flows from the regulator 62 to the fan motor 29 via the detection transistor Tr3, the resistor R5, and the diode D1. The minute electric current becomes a base current to turn on the detection transistor Tr3. The motor connection detection signal of H level is supplied to the microcomputer 61. On the other hand, when the fan motor 29 is not connected to the control circuit 40 normally, the detection transistor Tr3 is in an off state and the motor connection detection signal of L level is supplied to the microcomputer 61.

In the gas nailer 1 of the present embodiment, when the contact arm 6 is pressed against the workpiece material W and the contact arm SW 34 is turned on (i.e., when the contact arm SW signal of L level is supplied to the microcomputer 61 from the contact arm SW input circuit 51), the microcomputer 61 checks the motor connection detection signal from the motor connection detection circuit 55. When the motor connection detection signal is L level (i.e., when the fan motor 29 is not connected normally), the motor driving signal to the fan motor operation circuit 54 remains L level. When the motor connection detection signal is H level (i.e., when the fan motor 29 is connected normally), the motor driving signal of H level is supplied to the fan motor operation circuit 54 to rotate the fan motor 29. In a specific case, however, the fan motor 29 is rotated regardless of the state of the motor connection detection signal. Description of such case will be given later.

The ignition power supply circuit 56 is a circuit for supplying/interrupting power from the battery 11 to the ignition circuit 59. The ignition power supply circuit 56 is configured similar to the fan motor operation circuit 54. More particularly, the ignition power supply circuit 56 includes a control transistor (NPN type bipolar transistor) Tr4 and a current-carrying transistor (PNP type bipolar transistor) Tr5. The respective transistors Tr4 and Tr5 are connected in the same manner as in the fan motor operation circuit 54. A base of the control transistor Tr4 is connected to a prescribed port of the microcomputer 61. From this port, an ignition power supply signal (H level or L level) is outputted to the ignition power supply circuit 56.

With the above-described configuration, when the ignition power supply signal of L level is supplied from the microcomputer 61 to the ignition power supply circuit 56, both the transistors Tr4 and Tr5 are turned off. Power is not supplied to the ignition circuit 59. On the other hand, when the ignition power supply signal of H level is supplied from the microcomputer 61 to the ignition power supply circuit 56, both the transistors Tr4 and Tr5 are turned on. Power is supplied from the battery 11 to the ignition circuit 59.

The ignition power detection circuit 57 is a circuit for detecting whether or not power is supplied from the ignition power supply circuit 56 to the ignition circuit 59. The ignition power detection circuit 57 includes a detection transistor (NPN type bipolar transistor) Tr6 and a pull-up resistor R7. One end of the pull-up resistor R7 is connected to the regulator 62 so that the constant voltage power is supplied to the one end of the pull-up resister R7. The other end is connected to a collector of the detection transistor Tr6 and also connected to a prescribed port of the microcomputer 61. A base of the detection transistor Tr6 is connected to an output side of the ignition power supply circuit 56.

With the above-described configuration, when the ignition power supply signal of L level is outputted from the microcomputer 61 to the ignition power supply circuit 56 to stop power supply from the ignition power supply circuit 56 to the ignition circuit 59, the detection transistor Tr6 inside the ignition power detection circuit 57 is turned off. Thus, an ignition power detection signal of H level is outputted from the ignition power detection circuit 57 to the microcomputer 61. On the other hand, when the ignition power supply signal of H level is outputted from the microcomputer 61 to the ignition power supply circuit 56 to supply power from the ignition power supply circuit 56 to the ignition circuit 59, the detection transistor Tr6 inside the ignition power detection circuit 57 is turned on. The ignition power detection signal from the ignition power detection circuit 57 to the microcomputer 61 becomes L level.

The ignition control circuit 58 includes a control transistor (NPN type bipolar transistor) Tr7. A base of the control transistor Tr7 is connected to a prescribed port of the microcomputer 61. An emitter of the control transistor Tr7 is grounded. A collector of the control transistor Tr7 is connected to a pull-up resistor R11 inside the ignition circuit 59. With such configuration, when the ignition control signal from the microcomputer 61 to the ignition control circuit 58 is L level, the control transistor Tr7 is in an off state. Thus, a control input signal of H level is supplied from the ignition control circuit 58 to the ignition circuit 59. On the other hand, when the ignition control signal from the microcomputer 61 to the ignition control circuit 58 is H level, the control transistor Tr7 is turned on. The control input signal of L level is supplied from the ignition control circuit 58 to the ignition circuit 59.

The ignition circuit 59 performs ignition operation once with the battery power supplied from the ignition power supply circuit 56 when the control input signal of H level is supplied from the ignition control circuit 58 (i.e., the ignition control signal of L level is supplied from the microcomputer 61 to the ignition control circuit 58).

More particularly, when the control input signal of H level is supplied from the ignition control circuit 58, the control unit 64 inside the ignition circuit 59 generates a voltage higher than the voltage (e.g., 6 V) of the battery 11 by a not shown internal booster circuit. With the generated high voltage, a charging capacitor C2 is charged up to a predetermined high voltage value (e.g., a hundred and several tens V).

One end of the charging capacitor C2 is connected to the control unit 64. The other end is connected to one end of a primary coil L1 of an ignition coil 65. The other end of the primary coil L1 is connected to the control unit 64. Between the one end of the charging capacitor C2 and the other end of the primary coil L1, a discharge thyristor SCR is provided. The discharge thyristor SCR, the charging capacitor C2 and the primary coil L1 constitute a closed circuit.

When a predetermined high voltage is charged to the charging capacitor C2, the control unit 64 outputs an ignition signal (pulse signal) to a gate of the discharge thyristor SCR. Thereby, the discharge thyristor SCR becomes conductive, and a charged electric charge of the capacitor C2 is rapidly discharged through the discharge thyristor SCR and the primary coil L1. Thereby, a high voltage is induced in a secondary coil L2 of the ignition coil 65. Due to the high voltage, the ignition plug 33 sparks (i.e., a discharge due to high voltage occurs in an air gap between the electrodes 33*a* and 33*b*). At this time, as later described, the fuel gas is normally in a state supplied into the combustion chamber 27 and stirred by the fan 30. Thus, with a spark of the ignition plug 33, the fuel gas inside the combustion chamber 27 explodes.

In the gas nailer 1 of the present embodiment, when the trigger 7 is pulled and the trigger SW 35 is turned on, the battery power is supplied to the ignition circuit 59. The microcomputer 61, however, does not output the ignition power supply signal of H level to the ignition power supply circuit 56 and supply the battery power from the ignition power supply circuit 56 to the ignition circuit 59 unconditionally, merely by the fact that the trigger SW 35 is turned on.

The microcomputer 61, regardless of on/off of the trigger SW 35, continuously monitors power supply to the ignition circuit 59 based on the ignition power detection signal from the ignition power detection circuit 57. When the trigger SW 35 is turned on while the battery power is not supplied to the ignition circuit 59 (the ignition power detection signal is H level), the microcomputer 61 outputs the ignition power supply signal of H level to the ignition power supply circuit 56 and outputs the ignition control signal of L level to the ignition control circuit 58 for a predetermined period of time. Thereby, power from the battery 11 is supplied to the ignition circuit 59 through the ignition power supply circuit 56, and the control input signal of H level is supplied from the ignition control circuit 58 for a predetermined period of time. During the period in the ignition circuit 59, a series of ignition operation is performed as noted above from charging to the charging capacitor C2 to sparking of the ignition plug 33.

In case that the battery power is supplied to the ignition circuit 59 for some reason (i.e., the ignition power detection signal is L level), although the microcomputer 61 outputs the ignition power supply signal of L level to the ignition power supply circuit 56 (i.e., a command is outputted to stop the battery power supply to the ignition circuit 59), the ignition circuit 59 does not operate even if the trigger SW 35 is turned on. More particularly, it is determined that the gas nailer 1 is in a failure state once it is detected that the ignition power detection signal is L level although the trigger SW 35 is in an off state. Until recovery from the failure, operation such as the ignition operation and rotation of the fan motor 29 is not performed at all (details will be described later).

The indication circuit 60 has the three LEDs 46, 47, and 48. The LEDs 46, 47 and 48 constitute the indication lamp 45 on the substrate 41 of the control circuit 40, as described in FIG. 2. The LEDs 46, 47 and 48 are connected in parallel on a current carrying path from the regulator 62 to the microcomputer 61 by way of the indication circuit 60. All the LEDs 46, 47 and 48 are lighted by a constant voltage power from the regulator 62. In the present embodiment, the LEDs 46, 47 and 48 are configured to emit different colors of light upon lighting. In the following description, it is assumed, as an example, that a red light is emitted from the LED 46, a green light is emitted from the LED 47, and an orange light is emitted from the LED 48.

In the LED 46 which emits a red light, an anode is connected to the regulator 62 side via a resistor R8, and a cathode is connected to a prescribed port of the microcomputer 61. When the signal from this port is H level, the LED 46 is not lighted. When the signal from the port is L level, a current flows from the regulator 62 to the microcomputer 61 by way of the resistor R8 and the LED 46 to light the LED 46. The same applies to the other two LEDs 47 and 48. In the LED 47 which emits a green light, when the signal from a prescribed port of the microcomputer 61 to which a cathode is connected is L level, a current flows from the regulator 62 to the microcomputer 61 by way of a resistor R9 and the LED 47 to light the LED 47. In the LED 48 which emits an orange light as well, when the signal from a prescribed port of the microcomputer 61 to which a cathode is connected is L level, a current flows from the regulator 62 to the microcomputer 61 by way of a resistor R10 and the LED 48 to light the LED 48.

Now, a basic operation of the gas nailer 1 of the present embodiment configured as above will be described, referring to FIGS. 1 to 3.

Normally, the gas nailer 1 rests in a state shown in FIG. 2. More particularly, the contact arm 6 and the combustion chamber frame 23 connected thereto are moved forward by a biasing force of a not shown spring. The combustion chamber 27 is not yet formed (not sealed). Under such condition, when the user of the gas nailer 1 grips the handle 5 and the front end of the contact arm 6 is pressed against the workpiece material W to move the contact arm 6 backward against the biasing force of the spring, the combustion chamber frame 23 also moves backward. Thereby, the sealed combustion chamber 27 is formed and the fuel gas from the fuel gas can is jetted into the combustion chamber 27 from the fuel gas jet opening 32. Also at this time, under the condition that the contact arm SW 34 is turned on and the motor connection detection signal from the motor connection detection circuit 55 to the microcomputer 61 is H level (i.e., the fan motor 29 is connected normally; see FIG. 3), the fan motor 29 rotates. Also, the interlock of the trigger 7 is released and the trigger 7 is able to be pulled. By the rotation of the fan motor 29, the fan 30 inside the combustion chamber 27 rotates. The fuel gas is mixed/stirred with air inside the combustion chamber 27.

Thereafter, when the trigger 7 is pulled to turn on the trigger SW 35, and under the condition that the ignition power detection signal from the ignition power detection circuit 57 to the microcomputer 61 is H level (i.e., power is not yet supplied to the ignition circuit 59 at the time when the trigger SW is turned on), the control input signal of H level is supplied from the ignition control circuit 58 to the ignition circuit 59, the power supply from the ignition power supply circuit 56 to the ignition circuit 59 is started, and operation of the ignition circuit 59 is started. Thereby, the ignition plug 33 sparks once.

As a result of the spark, the fuel gas mixed/stirred with air inside the combustion chamber 27 explodes. Due to the explosion power, the piston 16 rapidly moves forward. Thereby, the driver blade 17 connected to the piston 16 also rapidly moves forward to push out a nail. Thereby, one nail is ejected from the ejector 12 and driven into the workpiece material W.

After the driving of the nail, the user returns the trigger 7 to its original position and separates the contact arm 6 from the workpiece material W. Then the contact arm 6 and the combustion chamber frame 23 return to their original positions (at normal times). Even if the contact arm 6 is returned to its original position and the contact arm SW 34 is turned off, the fan motor 29 does not stop rotation right away and continues to rotate for a predetermined period of time (e.g., 7 seconds). During the rotation, discharge of exhaust gas inside the combustion chamber 27, cooling of the combustion chamber 27 and its peripheral parts inside the gas nailer 1, etc. are performed.

In other words, after the contact arm SW 34 is turned on and the motor driving signal of H level is outputted to the fan motor operation circuit 54 to drive the fan motor 29, the microcomputer 61 does not set the motor driving signal to L level right away and keeps the signal of H level for a predetermined period of time (7 seconds in the present embodiment) even if the contact arm SW 34 is turned off. After the predetermined period of time has elapsed, the motor driving signal is set to L level to stop the power supply from the fan motor operation circuit 54 to the fan motor 29 and to stop the rotation of the fan 30.

As previously noted, even if the contact arm 6 is separated from the workpiece material W in a state in which the trigger 7 is pulled, the contact arm 6 does not return to its original (forward) position at normal times due to the interlock.

(3) Failure Detection Function and Failure State Indication Function of Gas Nailer 1

Now, description is given on a failure detection function and a failure state indication function provided in the gas nailer 1 of the present embodiment. The gas nailer 1 of the present embodiment is configured as described based on FIGS. 1 to 3 and basically operates as previously described. In addition, the gas nailer 1 is configured to detect failure in the case of failure, and offer indication corresponding to the state of the detected failure through the indication light 45 (i.e., three LEDs 46, 47 and 48 constituting the indication circuit 60). The detection of failure and indication by the indication light 45 corresponding to the failure state are mainly executed by the microcomputer 61 inside the control circuit 40.

TABLE 1 shows the failure states detectable by the gas nailer 1 of the present embodiment, causes of failure, recovery methods, indication patterns by the indication light 45 (three LEDs 46, 47, and 48) per failure state.

TABLE 1

| Failure state | | Indication | Cause (detection purpose) | | Recovery method from |
|---|---|---|---|---|---|
| No. | particular detail | pattern | electrical cause | mechanical cause | failure state |
| 1 | Contact arm SW is in on state when battery is attached | A | Contact arm SW in always-on state (adhesion of movable contact, etc.) | Return failure of contact arm | Turn off both SW s |
| 2 | State in which contact arm SW is on and trigger SW is off continues for a predetermined time (5 sec.) | B | Contact arm SW in always-on state and/or trigger SW in always-off state (disconnection of connection line, etc.) | | Turn off contact arm SW |
| 3 | State in which contact arm SW is on and trigger SW is on continues for a predetermined time (5 sec.) | C | Contact arm SW in always-on state and/or trigger SW in always-on state | Return failure of trigger | Turn off both SW s |
| 4 | 4-1 Trigger SW is in on state when battery is attached<br>4-2 Contact arm SW has changed from on to off while trigger SW is in on state | D | Trigger SW in always-on state | Damage in lock mechanism (interlock) of trigger | Restore power |
| 5 | Only trigger SW is in on state while contact arm SW is in off state | E | Contact arm SW in always-off state | | |
| 6 | Fan motor is not connected | F | Disconnection of fan motor connection line, etc. | — | |
| 7 | Power is supplied to ignition circuit at all times | G | Abnormality in ignition power supply circuit | | |
| 8 | Battery voltage is decreased | H | Decrease in battery capacity | | |

As shown in TABLE 1, in the gas nailer 1 of the present embodiment, eight kinds of failure states can be detected by the control circuit 40. Also, upon detection of any one of the failure states, the three LEDs 46, 47 and 48 are lighted according to the indication pattern preset corresponding to the detected failure state. Therefore, if some failure occurs to the gas nailer 1, the user or a person who repairs/maintains the gas nailer 1 can grasp the detail of the failure by looking at the indication (indication pattern) of the indication light 45.

The respective indication patterns A to H are set as below in the present embodiment. More particularly, when the control circuit 40 (the microcomputer 61, in detail) detects any one of the failure states "1" to "8", the red LED 46 and the green LED 47 are alternately lighted (each of the LEDs 46 and 47 is lighted for 0.5 seconds by turns) for 5 seconds in total. This alternate lighting of 5 seconds is performed without exception regardless of the kinds of the failure states. The lighting is for reporting occurrence of failure to the users (occurrence report lighting). The control circuit 40, following the occurrence report lighting, lights on and off the orange LED 48 at a number of times corresponding to the indication pattern (i.e., the same number as the number of the failure state). For example, in the case of the failure state "5", the orange LED 48 is blinked on and off times. The blinking of the orange LED 48 is performed for a number of times corresponding to the kind of the failure state. The blinking is for particularly reporting what failure has occurred to the users (detail report blinking). Hereafter, the occurrence report lighting and the detail report blinking are repeatedly performed in the same manner.

As noted above, the users are able to recognize occurrence of failure by the occurrence report lighting, and grasp which of the failure states "1" to "8" has occurred by confirming the number of blinking of the orange LED 48 in the following detail report, blinking.

Now, more particular description will be given on the respective eight kinds of failure states which can be detected by the control circuit 40 in the gas nailer 1.

As previously described, the following incidents cannot occur due to presence of the interlock if the gas nailer 1 of the present embodiment is both mechanically and electrically normal without failure: only the trigger SW 35 is turned on although the contact arm SW 34 is in an off state; and the contact arm SW 34 is turned off even if the trigger SW 35 is still in an on state after the trigger 7 is pulled (i.e., after both the SW 34 and 35 are turned on). In other words, when the trigger SW 35 is turned on, the contact arm SW 34 has to be already turned on. When the contact arm SW 34 is turned off after the trigger 7 is pulled, the trigger SW 35 has to be already turned off. With these points in mind, the respective failure states will be particularly described hereinafter.

(3-1) Failure State "1"

As shown in TABLE 1, the failure state "1" represents a state in which the battery 11 is attached while the contact arm SW 34 is in an on state, that is, the contact arm SW 34 is already in an on state when the battery 11 is attached. Accordingly, whether or not the gas nailer is in the failure state "1" is determined immediately after the battery 11 is attached to power on the control circuit 40 and the control circuit 40 starts its operation.

Normally, when the users attach the battery 11 to the gas nailer 1, the contact arm 6 is not pressed against the workpiece material W or others. Thus, the contact arm SW 34 should be in an off state. However, for some reason, a failure may occur in which the contact arm SW 34 is in an on state although the contact arm 6 is not pressed against the workpiece material W or others.

Therefore, in the control circuit 40, the microcomputer 61 determines the state of the contact arm SW 34 based on a contact arm SW signal from the contact arm SW input circuit 51. When the contact arm SW 34 is in an on state (the contact arm SW signal is L level), the microcomputer 61 determines that the gas nailer 1 is in the failure state "1". The indication lamp 45 is lighted in an indication pattern A preset corresponding to the failure state "1".

Why the contact arm SW 34 is already in an on state upon attachment of the battery 11 is assumed because of an electrical cause and a mechanical cause. An example of the electrical cause is that the contact arm SW 34 is forced into an always-on state regardless of the state/position of the contact arm 6 due to adhesion of the movable contact 34*a*. An example of the mechanical cause is a return failure of the contact arm 6, that is, the contact arm 6 remains in a state moved backward (i.e., in a state pressed against the workpiece material W) and never returns. The failure state "1" may occur due to the use state and the manner of operation of the user, even if no failure has occurred to the gas nailer 1. For example, the user may attach the battery 11 without intension (or intentionally) while pressing the contact arm 6 against something.

When the failure state "1" is detected as above, the indication lamp 45 is lighted in the indication pattern A. Thus, the user or the repair person can grasp from the indication pattern what kind of failure has occurred and what can be the cause of the failure. Prompt and accurate measures can be taken for the failure. Also, when the failure state "1" is detected, the gas nailer 1 is set to be in a lightly failed state. More particularly, as later described, the microcomputer 61 sets a light failure flag LF to '1'. Until the gas nailer 1 is recovered from the occurred failure, driving in of a nail is disabled.

After the cause of the failure state "1" is removed by repair and so on and the gas nailer 1 returns to normal, the microcomputer 61 turns off both the contact arm SW 34 and the trigger SW 35 to reset the light failure flag LF to '0', as later described. The gas nailer 1 is released from the lightly failed state to be recovered to a normal state. After the failure state "1" is detected and the gas nailer 1 is set to be in a lightly failed state and then released from the lightly failed state, the fan 30 is rotated for a predetermined period of time (7 seconds in the present embodiment; the detail will be described later). The same applies to the case where the gas nailer 1 is released from the lightly failed state in the failure states "2" and "3".

(3-2) Failure State "2"

As shown in TABLE 1, the failure state "2" represents a case where a state in which the contact arm SW 34 is on and the trigger SW 35 is off continues for a predetermined period of time (5 seconds in the present embodiment). The failure state "2" presupposes that the gas nailer 1 is normal upon attachment of the battery 11 and the failure state "1" has not been detected.

The failure state "2" occurs when one or both of the cases takes place where the contact arm SW 34 continues to be in an on state and where the trigger SW 35 continues to be in an off state for some reason. The particular cause is assumed because of an electrical cause and a mechanical cause. Examples of the electrical cause are that the contact arm SW 34 is forced into an always-on state due to adhesion of the movable contact 34*a* and that a power line connected to the trigger SW 35 is disconnected. An example of the mechanical cause is a return failure of the contact arm 6 as noted above.

Therefore, in the control circuit 40, the microcomputer 61 determines whether or not the state in which the contact arm SW 34 is on and the trigger SW 35 is off continues for five seconds or more based on the contact arm SW signal from the contact arm SW input circuit 51 and the trigger SW signal from the trigger SW input circuit 52. In case that the above state has continued for five seconds or more, the microcomputer 61 determines that the gas nailer 1 is in the failure state "2". The indication lamp 45 is lighted in an indication pattern B preset corresponding to the failure state "2".

The failure state "2" occurs, for example, when both the contact arm SW 34 and the trigger SW 35 fail due to the above-described electrical cause. Also, even if only the contact arm SW 34 fails due to the above-described electrical cause, the trigger 7 is normally in a state unpulled (i.e., the trigger SW 35 is in an off state). Thus, if a state in which the trigger 7 is not pulled continues for five seconds or more, the failure state "2" occurs. Also, for example, in case that only the trigger SW 35 fails due to the above-described electrical cause, the trigger SW 35 is not turned on and a nail is unable to be driven even after the user presses the contact arm against the workpiece material W (i.e., after the contact arm SW 34 is turned on) upon driving in of the nail and then pulls the trigger 7. It is then assumed that the user may pull the trigger 7 repeatedly or continuously while pressing the contact arm 6 against the workpiece material W. In this case as well, the fail state "2" may occur.

The failure state "2" may occur due to the use state and the manner of operation by the user, even if no failure has occurred to the gas nailer 1. Normally, it is considered natural transition that, when driving in a nail using the gas nailer 1, the users press the contact arm 6 against the work material W and pull the trigger 7, and, after driving in of the nail, promptly returns the trigger 7 and separate the contact arm 6 from the workpiece material W to prepare for the next operation. However, if a state in which the contact arm 6 is pressed against the workpiece material W is continued for five seconds or more even after the trigger 7 is returned to its original position, the failure state "2" is detected.

When the failure state "2" is detected, the indication lamp 45 is lighted in the indication pattern B. Thus, the user or the repair person looks at the indication pattern and can understand what kind of failure has occurred and what can be the cause of the failure. Prompt and accurate measures can be taken for the failure. Also, when the failure state "2" is detected, the gas nailer 1 is set to be in a lightly failed state (the light failure flag LF is set to '1'). Until the gas nailer 1 is recovered from the occurred failure, driving in of a nail is disabled. When the fan 30 is rotating (the fan motor 29 is rotating) upon occurrence of failure, the control circuit 40 stops the rotation. The same applies to the case of the later-described failure state "3".

After the cause of the failure state "2" is removed by repair and so on and the gas nailer 1 returns to normal, the microcomputer 61 turns off the contact arm SW 34 to reset the light failure flag LF to '0', as later described. The gas nailer 1 is released from the lightly failed state to be recovered to a normal state. Accordingly, when the failure state "2" is detected due to the manner of operation even if the gas nailer 1 is normal, the gas nailer 1 can be recovered to a normal state by returning the contact arm 6 to the position at normal times and turning off the contact arm SW 34.

(3-3) Failure State "3"

As shown in TABLE 1, the failure state "3" represents a case where a state in which both the contact arm SW 34 and the trigger SW 35 are turned on continues for a predetermined period of time (5 seconds in the present embodiment). The failure state "3" as well presupposes that the gas nailer 1 is normal upon attachment of the battery 11 and the failure state "1" has not been detected.

Why the failure state "3" occurs is assumed because of an electrical cause and a mechanical cause. Examples of the electrical cause are that the contact arm SW 34 is forced into an always-on state due to adhesion of the movable contact 34*a* of the contact arm SW 34 and that the trigger SW 35 is forced into an always-on state due to adhesion of the movable contact 35*a* of the trigger SW 35. An example of the mechanical cause is a return failure of the trigger SW 35. When the trigger SW 35 is not returned to its original state (state before pulled) due to return failure, the contact arm 6 is also not returned (unable to be returned) to its original state due to the interlock. Thus, the both SWs 34 and 35 are in an on state.

Therefore, in the control circuit 40, the microcomputer 61 determines whether or not the state in which both the contact arm SW 34 and the trigger SW 35 are turned on continues for five seconds or more, based on the contact arm SW signal from the contact arm SW input circuit 51 and the trigger SW signal from the trigger SW input circuit 52. In case that the above state has continued for five seconds or more, the microcomputer 61 determines that the gas nailer 1 is in the failure state "3". The indication lamp 45 is lighted in an indication pattern C preset corresponding to the failure state "3".

The failure state "3" may occur due to the use state and the manner of operation by the user, even if no failure has occurred to the gas nailer 1. More particularly, when driving in a nail in an ordinary operation manner, the user presses the contact arm 6 against the work material W and pulls the trigger 7. Thus, upon driving in of the nail, both the SWs 34 and 35 have to be in an on state inevitably. In this case, it is normally considered natural transition that, after driving in of the nail, the user promptly returns the trigger 7 and separates the contact arm 6 from the workpiece material W to prepare for the next operation. However, if a state in which the trigger 7 is pulled by the user is continued for five seconds or more even after driving in of the nail, the failure state "3" is detected.

When the failure state "3" is detected, the indication lamp 45 is lighted in the indication pattern C. Thus, the user or the repair person looks at the indication pattern and can understand what kind of failure has occurred and what can be the cause of the failure. Prompt and accurate measures can be taken for the failure. Also, when the failure state "3" is detected, the gas nailer 1 is set to be in a lightly failed state (the light failure flag LF is set to '1'). Until the gas nailer 1 is recovered from the occurred failure, driving in of a nail is disabled.

After the cause of the failure state "3" is removed by repair and so on and the gas nailer 1 returns to normal, the microcomputer 61 turns off both the contact arm SW 34 and the trigger SW 35 to reset the light failure flag LF to '0', as later described. The gas nailer 1 is released from the lightly failed state to be recovered to a normal state. Accordingly, when the failure state "3" is detected due to the manner of operation even if the gas nailer 1 is normal, the gas nailer 1 can be returned to a normal condition by returning the trigger 7 as well as the contact arm 6 to the positions at normal times and turning off both the SWs 34 and 35.

(3-4) Failure State "4"

As shown in TABLE 1, the failure state "4" represents a state in which the battery 11 is attached while the trigger SW 35 is turned on (that is, the trigger SW 35 is already in an on state when the battery 11 is attached), or a state in which the contact arm SW 34 is changed from on to off while the trigger SW 35 is turned on. In the following description, the former of the above-described two kinds of states representing the failure state "4" is referred to as the failure state "4-1" and the latter is referred to as the failure state "4-2".

Whether or not the gas nailer 1 is in the failure state "4-1" is determined immediately after the battery 11 is attached to power on the control circuit 40 and the control circuit 40 starts its operation. On the other hand, the failure state "4-2" presupposes that the gas nailer 1 is normal upon attachment of the battery 11 and the failure states "4-1" and "1" have not been detected.

Normally, when the users attach the battery 11 to the gas nailer 1, the trigger 7 is not pulled and, even if the user attempts to pull the trigger 7, the trigger 7 is unable to be pulled by the interlock (presupposing that the contact arm 6 is not pressed against the workpiece material W). Thus, the trigger SW 35 should be in an off state. However, for some reason, a failure (failure state "4-1") may occur in which the trigger SW 35 is in an on state although the trigger 7 is not pulled.

Therefore, in the control circuit 40, the microcomputer 61 determines the state of the trigger SW 35 based on the trigger SW signal from the trigger SW input circuit 52 upon the start of operation of the control circuit 40. When the trigger SW 35 is in an on state (the trigger SW signal is L level), the microcomputer 61 determines that the gas nailer 1 is in the failure state "4-1". The indication lamp 45 is lighted in an indication pattern D preset corresponding to the failure state "4-1".

With respect to the failure state "4-2", the microcomputer 61 makes a determination as follows. That is, the microcomputer 61 determines that the gas nailer 1 is in the failure state "4-2" when, after both the SWs 34 and 35 are turned on based on the contact arm SW signal from the contact arm SW input circuit 51 and the trigger SW signal from the trigger SW input circuit 52, only the contact arm SW 34 is turned off while the trigger SW 35 remains in an on state. The indication lamp 45 is lighted in an indication pattern D (the same indication pattern as the failure state "4-1") preset corresponding to the failure state "4-2".

Why the failure states "4" (failure states "4-1" and "4-2") occur is assumed because of an electrical cause and a mechanical cause. An example of the electrical cause is that the trigger SW 35 is forced into an always-on state regardless of the state/position of the trigger 7 due to adhesion of the movable contact 35*a*. An example of the mechanical cause is damage in the interlock or a return failure of the trigger 7, that is, the trigger 7 remains in a state always pulled although the contact arm 6 is in a normal state.

When the failure states "4" are detected as above, the indication lamp 45 is lighted in the indication pattern D. Thus, the user or the repair person looks at the indication pattern and can grasp what kind of failure has occurred and what can be the cause of the failure. Prompt and accurate measures can be taken for the failure. Also, when the failure states "4" are detected, the gas nailer 1 is set to be in a heavily failed state. More particularly, as later described, the microcomputer 61 sets a heavy failure flag EF to '1'. Until the gas nailer 1 is recovered from the occurred failure, driving in of a nail is disabled.

Once the heavy failure flag EF is set to '1', the heavy failure flag EF is not reset thereafter as long as the control circuit 40 continues to operate, unlike the case of the light failure flag LF. Accordingly, even if the cause of the failure states "4" are removed by repair and so on, normal operation such as driving in of a nail is disabled as long as the control circuit 40 continues to operate. After the cause of the failure states "4" are removed and the gas nailer 1 returns to normal, power must be restored to the control circuit 40 (the battery 11 must be reattached) to be able to be used as usual.

The same applies to the later-described failure states "5" to "8". When the failure occurs, the heavy failure flag EF is set to '1'. After returning to a normal state by repair and so on, power (battery 11) is restored to recover the gas nailer 1 to a normal state. The reason why the failure states "1" to "3" are classified into the light failure state and the failure states "4" to "8" are classified into the heavy failure state is based on a recovery manner from the failure state to a normal state. More particularly, in the case of the failure states "1" to "3", the gas nailer 1 can be recovered by normal operation while, in the case of the failure states "4" to "8", the gas nailer 1 cannot be recovered unless restoration of power.

(3-5) Failure State "5"

As shown in TABLE 1, the failure state "5" represents a case where only the trigger SW 35 is in an on state while the contact arm SW 34 is in an off state. The failure state "5" presupposes that the gas nailer 1 is normal upon attachment of the battery 11 and the failure states "4-1" and "1" have not been detected.

Why the failure state "5" occurs is assumed because of an electrical cause and a mechanical cause. An example of the electrical cause is that a power line connecting the contact arm SW 34 and the control circuit 40 is disconnected and the contact arm SW 34 is forced into an always-off state regardless of the position of the contact arm 6. An example of the mechanical cause is damage in the interlock or a return failure of the trigger 7, as in the case of the failure states "4".

In the control circuit 40, the microcomputer 61 determines that the gas nailer 1 is in the failure state "5" when the trigger SW 35 is in an on state while the contact arm SW 34 is in an off state, based on the contact arm SW signal from the contact arm SW input circuit 51 and the trigger SW signal from the trigger SW input circuit 52. The indication lamp 45 is lighted in an indication pattern E preset corresponding to the failure state "5".

In the present embodiment, when the failure state "5" occurs, an ignition operation is performed once at the time of occurrence of the failure (i.e., when the trigger SW 35 is changed from off to on). Thereafter, no ignition operation is performed until the gas nailer 1 recovers from the failure state.

(3-6) Failure State "6"

As shown in TABLE 1, the failure state "6" represents a state in which the fan motor 29 and the control circuit 40 are not electrically connected. Why the failure state "6" occurs is assumed because of disconnection of a power line connecting the fan motor 29 and the control circuit 40.

In the control circuit 40, the microcomputer 61 determines whether or not the fan motor 29 is connected normally, based on the motor connection detection signal from the motor connection detection circuit 55. Particularly, the microcomputer 61 checks the state of the motor connection detection signal from the motor connection detection circuit 55 when the contact arm SW 34 is turned on.

If the motor connection detection signal is H level, it is determined that the fan motor 29 is connected normally. The motor driving signal of H level is outputted to the fan motor operation circuit 54 to rotate the fan motor 29. On the other hand, if the motor connection detection signal is L level, it is determined that the failure state "6" has occurred in which the fan motor 29 is not connected normally to the control circuit 40. The indication lamp 45 is lighted in an indication pattern F preset corresponding to the failure state "6".

(3-7) Failure State "7"

As shown in TABLE 1, the failure state "7" represents a state in the power (battery power) is supplied to the ignition circuit 59 at all times. More particularly, the failure state "7" is a state in which the battery power is supplied to the ignition circuit 59 through the ignition power supply circuit 56 although the microcomputer 61 outputs the ignition power supply signal of L level (a command to stop power supply to the ignition circuit 59) to the ignition power supply circuit 56.

Why the failure state "7" occurs is mainly because of failure of the ignition power supply circuit 56. In addition, the failure state "7" may possibly occur, for example, because of failure of the ignition power detection circuit 57, that is, on failure (failure of being in an always-on state) of the detection transistor Tr6 which constitutes the ignition power detection circuit 57. In this case, the ignition power detection signal of L level is supplied from the ignition power detection circuit 57 to the microcomputer 61 at all times.

In the control circuit 40, the microcomputer 61 determines a supply state of the battery power from the ignition power supply circuit 56 to the ignition circuit 59, based on the ignition power detection signal from the ignition power detection circuit 57. When it is determined that the battery power is already supplied to the ignition circuit 59 although the conditions to operate the ignition circuit 59 (the trigger SW 35 is turned on, etc.) are not satisfied, it is determined that the gas nailer 1 is in the failure state "7". The indication lamp 45 is lighted in an indication pattern G preset corresponding to the failure state "7".

(3-8) Failure State "8"

As shown in TABLE 1, the failure state "8" represents decrease in battery voltage, that is, a state in which the voltage of the battery power supplied from the battery 11 to the control circuit 40 is decreased and thus the control circuit 40 and the fan motor 29 may not be able to operate normally.

In the control circuit 40, the microcomputer 61 continuously determines whether or not the battery voltage is normal, based on the battery voltage signal supplied from the battery voltage detection circuit 53. When the level of the battery voltage signal falls to or below a predetermined battery voltage determination threshold, it is determined that the battery voltage is decreased and that the gas nailer 1 is in the failure state "8". The indication lamp 45 is lighted in an indication pattern H preset corresponding to the failure state "8".

(4) Drive Operation Control Process Executed in Control Circuit 40

Figure 4:
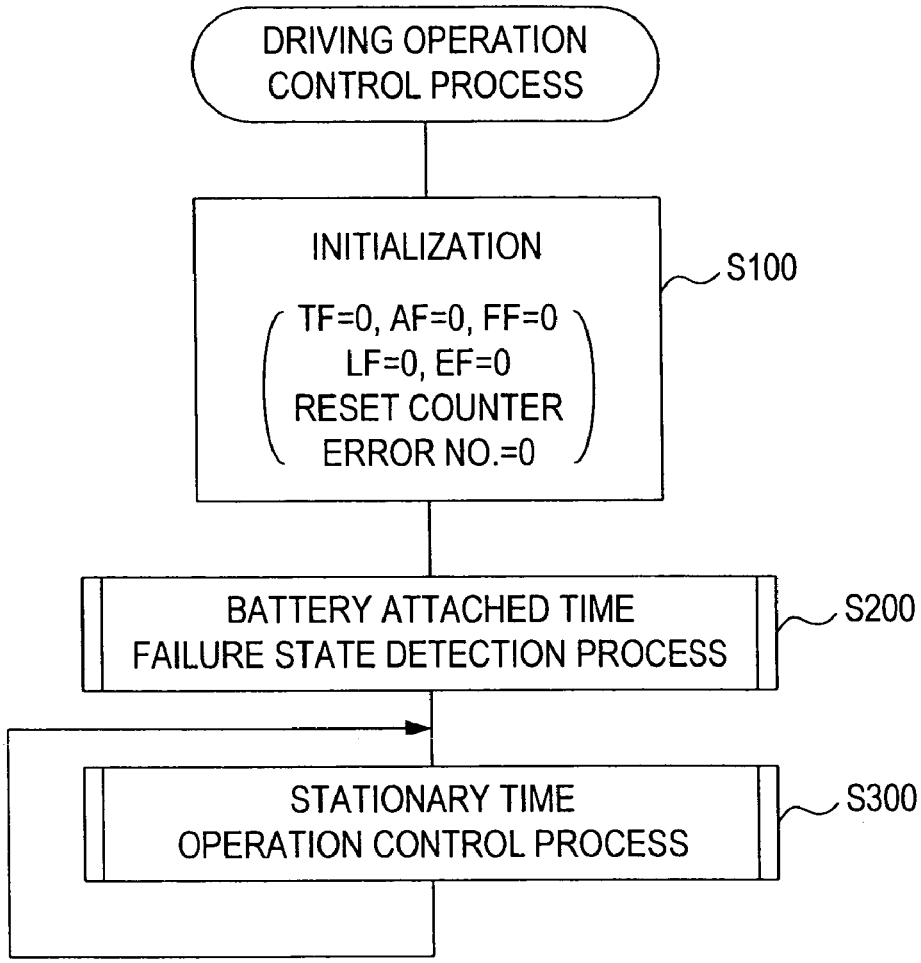
FIG. 4 is a flowchart showing a drive operation control process executed in the control circuit according to the first embodiment.

Now, a drive operation control process executed in the control circuit 40 will be described based on FIGS. 4 to 7. FIG. 4 is a flowchart showing the drive operation control process executed by the microcomputer 61 of the control circuit 40. When the battery 11 is attached to the gas nailer 1 and the control circuit 40 starts its operation, the CPU 66 reads out a drive operation control process program from the ROM 67 and executes the process according to the program in the microcomputer 61 of the control circuit 40. By execution of the drive operation control process, a series of nail driving operation from the operation of the fan motor 29 to the ignition operation, detection of the above-described failure states "1" to "8" (a failure detection function), and subsequent indication by the indication lamp 45 (a failure state indication function) are achieved.

When the drive operation control process shown in FIG. 4 is started, initialization of the control circuit 40 (initialization of the microcomputer 61, in detail) is performed at first in S100. Particularly, initialization of various kinds of flags set during the execution of the drive operation control process, resetting of the counter 69, resetting of an error number, and so on are performed.

The various kinds of flags include a trigger state flag TF indicating the operation state of the trigger 7, a contact arm state flag AF indicating the operation state of the contact arm 6, a fan state flag FF indicating the operation state of the fan motor 29 (i.e., the operation state of the fan 30), and the two kinds of failure flags indicating the failure states, that is, the light failure flag LF and the heavy failure flag EF.

Each flag is initialized (reset to '0') by the step of S100 in the initialized state. During a stationary time operation control process of S300, the trigger state flag TF is set to '1' when the trigger SW 35 is turned on and the ignition operation is performed, the contact arm state flag AF is set to '1' when the contact arm SW 34 is turned on, the fan state flag FF is set to '1' when the fan 30 is started to operate (rotate) by the fan motor 29, the light failure flag LF is set to '1' when one of the failure states "1" to "3" indicating the light failure states is detected, and the heavy failure flag EF is set to '1' when one of the failure states "4" to "8" indicating the heavy failure states is detected.

Also, the error number is set to one of the numbers '0' to '8'. The error number '0' indicates that the gas nailer 1 has no failure and is normal. The error numbers '1' to '8' corresponds to the above-described failure states "1" to "8", respectively. When detecting one of the failure states "1" to "8" during the respective steps of S200 and S300, the microcomputer 61 sets the error number corresponding to the value of the detected failure state and sets the failure flag (one of the light failure flag LF and the heavy failure flag EF) corresponding to the failure state to '1'. Also, the indication lamp 45 (the respective LEDs 46 to 48) is lighted in the indication pattern preset corresponding to the set error number.

Figure 5:
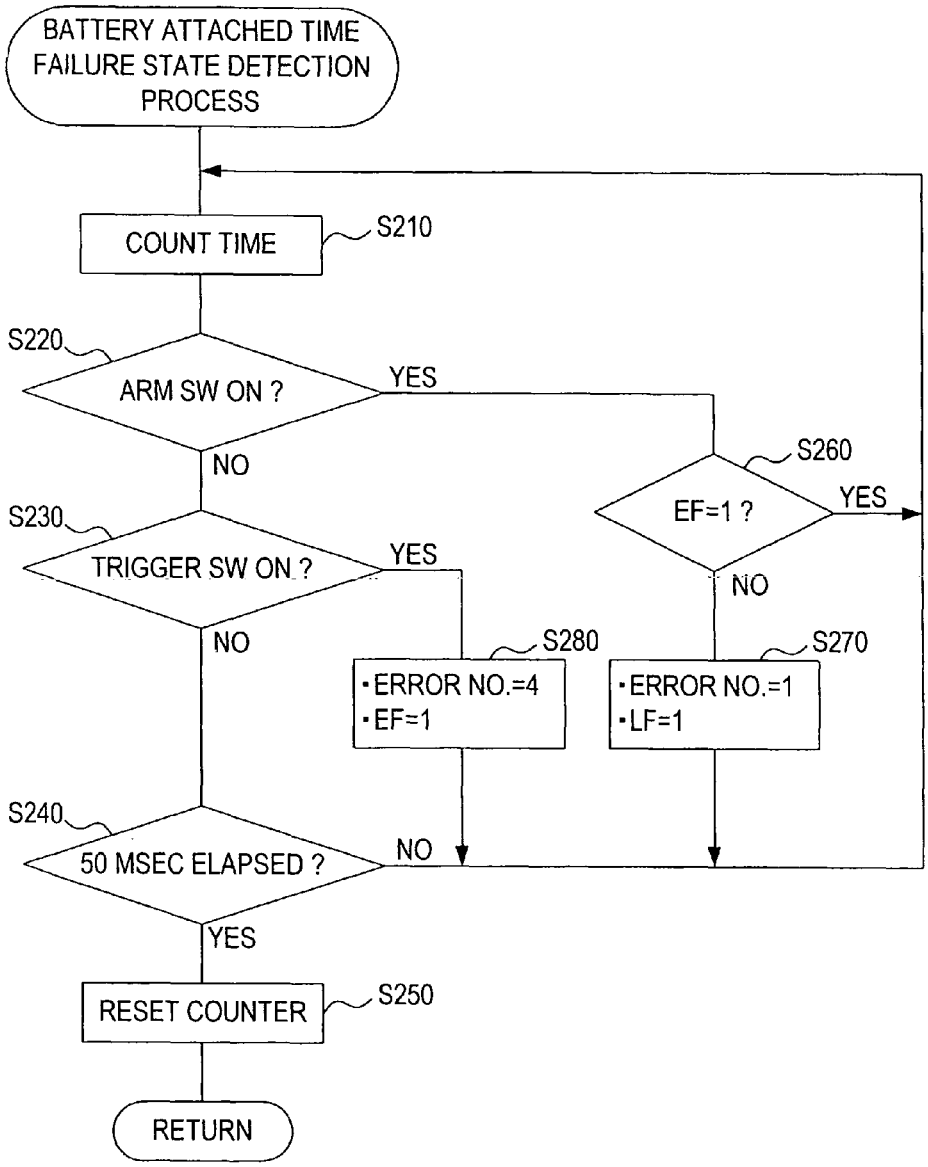
FIG. 5 is a flowchart showing details of a battery attached failure state detection process of S200 in the drive operation control process of FIG. 4.

After the initialization step of S100, the process proceeds to S200. A battery attached time failure state detection process is executed. This is the process executed only once each time the battery 11 is attached and the drive operation control process is started. The details are as shown in FIG. 5. The detailed description of FIG. 5 will be given later. To sum up, it is determined whether or not one of the failure states "1" or "4" (failure state "4-1" in detail) has occurred. If neither of the failures is detected, the process moves to S300. If either of the failures is detected, the process does not move to S300 until recovery from the failure.

In S300, the stationary time operation control process is executed. This process is continuously executed after the battery 11 is attached and the process of S200 is performed. The details are described later.

Now the battery attached time failure state detection process of S200 in the drive operation control process in FIG. 4 will be described in more detail based on FIG. 5. The battery attached time failure state detection process of S200 is carried out as shown in FIG. 5 in detail. More particularly, time count (time measurement) is performed firstly in S210 by the counter 69 inside the microcomputer 61. S210 is a step which continues time count in execution if the time count is already being executed. If time count is not in execution, time count is started anew. The same applies to later described steps of S380 (see FIG. 6), and S660 and S615 (see FIG. 7). Accordingly, in the initial step of S210 after attachment of the battery 11, time count is of course not started yet. Therefore, time count is started.

In subsequent S220, it is determined whether or not the contact arm SW 34 is in an on state. The "ARM SW" in FIGS. 5 to 7 indicates the contact arm SW 34. If it is determined in S220 that the contact arm SW 34 is in an off state, the process proceeds to S230 to determine whether or not the trigger SW 35 is in an on state. If the trigger SW 35 is also in an off state, the process proceeds to S240 to determine whether or not elapsed time from the start of time measurement in S210 is 50 msec or more. If 50 msec or more has not yet elapsed, the process returns to S210. If 50 msec or more has elapsed from the start of time measurement, the process proceeds to S250 to stop the time count and reset a counter value of the counter 69.

On the other hand, if the contact arm SW 34 is already in an on state for some reason upon attachment of battery, the error number is set to '1' and the light failure flag LF is set to '1' in S270, provided that the heavy failure flag EF is not yet set to '1' (S260: No). Setting the error number to '1' means that the gas nailer 1 is in the failure state "1" and the failure state "1" has been detected. If the error number '1' is set as such, the indication lamp 45 (the three LEDs 46 to 48) is lighted in the indication pattern A set corresponding to the error number '1' (failure state "1").

If the heavy failure flag EF is already set to '1' in the determination step of S260, the process does not proceed to S270 and returns to S210. In other words, even if the light failure state is detected, the state in which the heavy failure flag EF=1 is given priority in case the heavy failure state has already been detected before and the heavy failure flag EF is set to '1'.

As noted above, in the present embodiment, when the heavy failure flag EF is set to '1', that is, when the light failure state (one of the failure states "1" to "3") is detected anew in the condition that one of the failure states "4" to "8" has been detected, neither the light failure flag LF is set nor the indication lamp 45 is lighted in connection with the detected light failure state. Setting of the heavy failure flag EF and lighting of the indication lamp 45 in connection with the already detected heavy failure state are given priority. To the contrary, if the heavy failure state is detected anew when the light failure state has been detected and the light failure flag LF has been set to '1', the heavy failure flag EF is set to '1' and the indication lamp 45 is lighted in the indication pattern corresponding to the detected heavy failure state. If another heavy failure is detected anew after the heavy failure has been detected and the heavy failure flag EF has been set to '1', the newly detected heavy failure is not reflected on the indication of the indication lamp 45 and the indication corresponding to the previously detected heavy failure state continues.

Also, upon attachment of battery, if the contact arm SW 34 is in an off state (S220: NO) but the trigger SW 35 is already in an on state for some reason, it is positively determined in S230 and the process proceeds to S280 to set the error number to '4' and set the heavy failure flag EF to '1'. If the error number '4' is set as such, the indication lamp 45 is lighted in the indication pattern D set corresponding to the error number '4' (failure state "4"). The failure state "4" detected here is the failure state "4-1" in detail (see TABLE 1).

When the light failure flag LF is set in S270, normal operation such as driving in of a nail is disabled. When the contact arm SW 34 is turned into an off state to be recovered from the failure state "1" to a normal state as well as the trigger SW 35 remains in an off state (i.e., both the SWs 34 and 35 are in an off state), the light failure flag LF is reset to '0' by a later-described step of S440 in FIG. 6. Recovery from the failure state to a normal state is achieved.

In case that the heavy failure flag EF is set in S280 as well, normal operation such as driving in of a nail is disabled. In the case of heavy failure, the heavy failure flag EF is not reset even if the cause of the failure is removed and the hardware itself returns to normal. In order to enable normal operation once again after the gas nailer 1 once falls into the heavy failure state, it is necessary that the cause of the failure is removed and the battery power is restored as previously noted (i.e., the process is restarted from the initialization step of S100 in FIG. 4).

Figure 6:
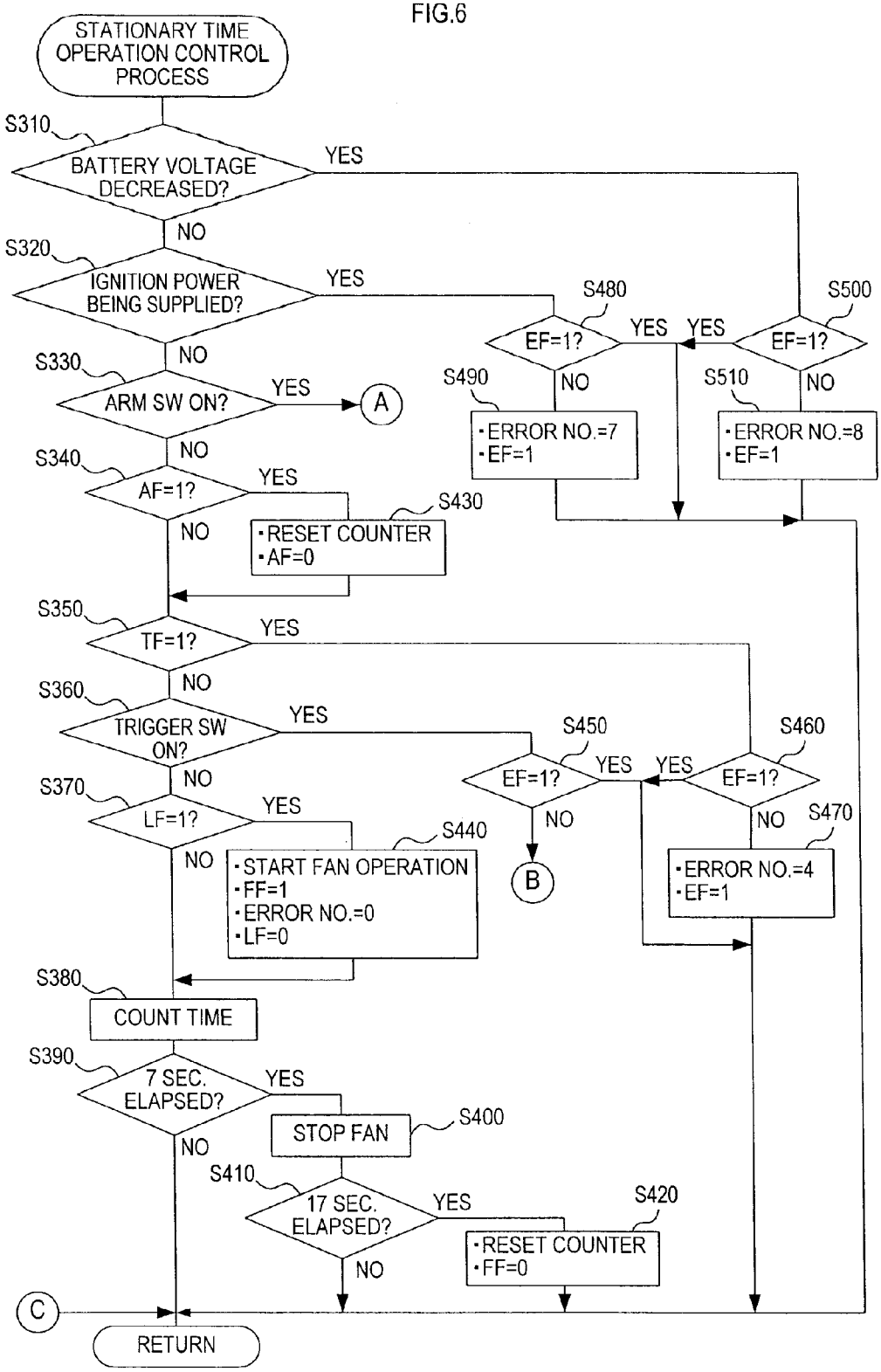
FIG. 6 is a flowchart showing details of a stationary time operation control process of S300 in the drive operation control process of FIG. 4.
Figure 7:
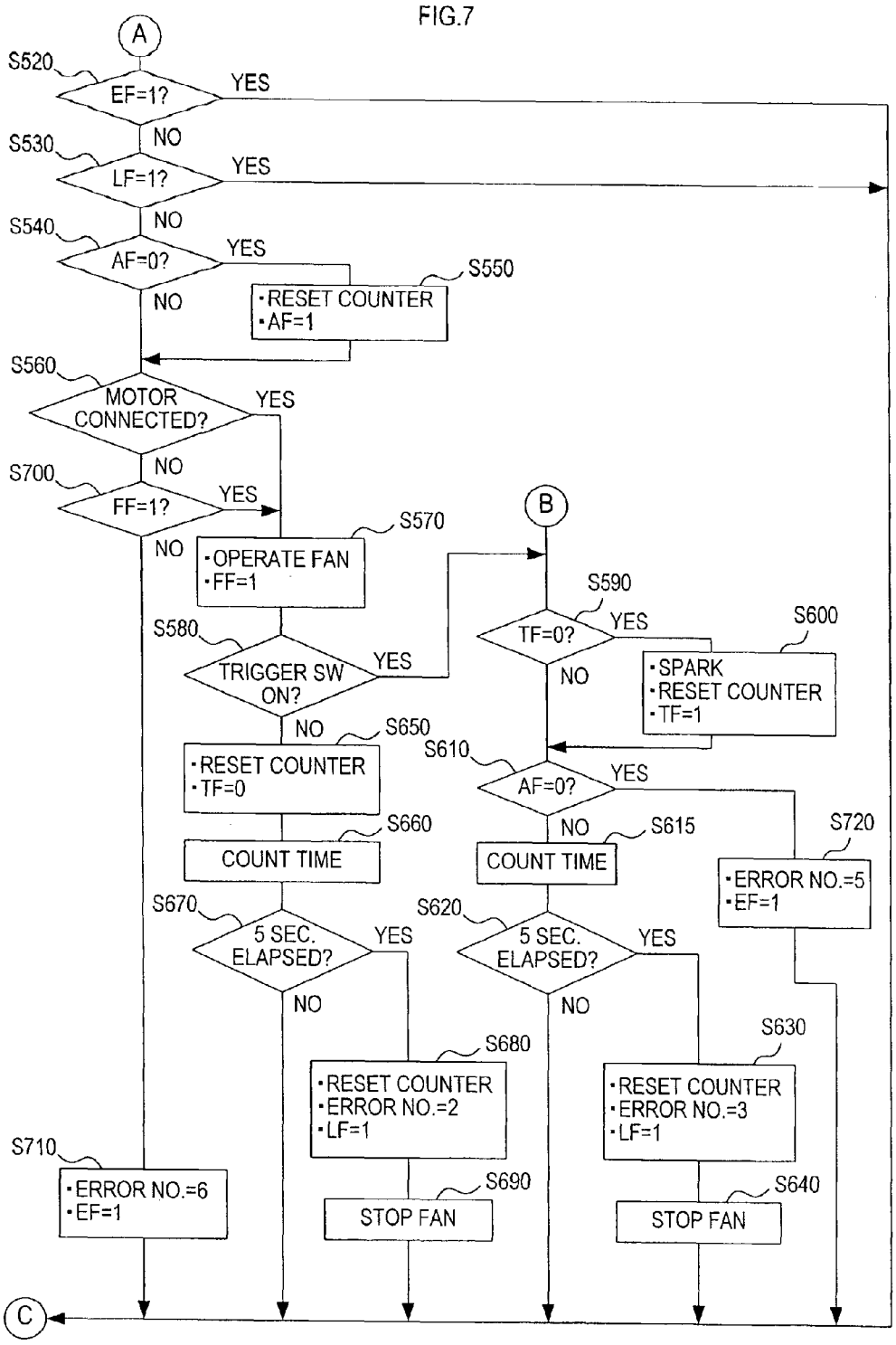
FIG. 7 is a flowchart showing details of the stationary time operation control process of S300 in the drive operation control process of FIG. 4.

Now, the stationary time operation control process of S300 in the drive operation control process in FIG. 4 will be described in more detail based on FIGS. 6 and 7. The stationary time operation control process of S300 is performed as shown in FIGS. 6 and 7 in detail. More particularly, firstly in S310 (FIG. 6), it is determined whether or not the battery voltage is decreased. The determination is performed by determining whether or not the battery voltage signal supplied to the microcomputer 61 is equal to or lower than the battery voltage determination threshold. If it is determined that the battery voltage is low (i.e., the battery voltage signal is equal to or lower than the battery voltage determination threshold), the error number is set to '8' and the heavy failure flag EF is set to '1' in S510, provided that the heavy failure flag EF is not yet set to '1' (S500: NO).

That the error number is set to '8' means that the gas nailer 1 is in the failure state "8" and the failure state "8" has been detected. If the error number '8' is set as such, the indication lamp 45 is lighted in the indication pattern H set corresponding to the error number '8' (failure state "8"). If the heavy failure flag EF is already set to '1' in the determination step of S500, the process does not proceed to S510 and ends the stationary time operation control process.

When it is determined in S310 that the battery voltage is not decreased, the process proceeds to S320 to determine whether or not the battery voltage is supplied to the ignition circuit 59. As previously noted, during the normal time when the gas nailer 1 is not operated, the ignition power supply circuit 56 in the control circuit 40 interrupts the battery power supply to the ignition circuit 59. Accordingly, if the gas nailer 1 is normal, the process proceeds to S330. If the battery power is supplied to the ignition circuit 59 for some reason, that is, in case that the ignition power detection signal of L level (signal indicating that the battery power is supplied to the ignition circuit 59) is outputted from the ignition power detection circuit 57 although the ignition power supply signal of L level (the command to stop the power supply to the ignition circuit 59) is supplied to the ignition power supply circuit 56, the process proceeds to S480. Provided that the heavy failure flag EF is not yet set to '1' (S480: NO), the error number is set to '7' and the heavy failure flag EF is set to '1' in S490.

That the error number is set to '7' means that the gas nailer 1 is in the failure state "7" and the failure state "7" has been detected. If the error number '7' is set as such, the indication lamp 45 is lighted in the indication pattern G set corresponding to the error number '7' (failure state "7"). If the heavy failure flag EF is already set to '1' in the determination step of S480, the process does not proceed to S490 and ends the stationary time operation control process.

In S330, it is determined whether or not the contact arm SW 34 is in an on state, based on the contact arm SW signal from the contact arm SW input circuit 51. Also, in S340, it is determined whether or not the contact arm state flag is set to '1'. In S350, it is determined whether or not the trigger state flag is set to '1'. In S360, it is determined whether or not the trigger SW 35 is in an on state.

Here, as long as the gas nailer 1 is not operated at all after the control circuit 40 starts to operate, both the contact arm SW 34 and the trigger SW 35 are still in an off state. Both the contact arm state flag AF and the trigger state flag TF are '0'. In that case, it is negatively determined in any of the determination step of S330, the determination step of S340 on whether or not the contact arm state flag AF is '1', the determination step of S350 on whether or not the trigger state flag TF is '1', and the determination step of S360 on whether or not the trigger SW 35 is in an on state. The process proceeds to S370.

In S370, it is determined whether or not the light failure flag LF is set to '1'. If the light failure flag LF is already set to '1', the fan motor 29 is driven to rotate the fan 30, and the fan state flag FF is set to '1' in S440. Also, the error number is reset to '0'. The light failure flag LF is also reset to '0'. Since the error number is reset to '0', indication which has been carried out by the indication lamp 45 is stopped. That the process has proceeded to S370 although the light failure flag LF is set to '1' (especially that it is negatively determined in both the determination steps of S330 and S360) means that the light failure state has occurred once but the cause has been removed and a normal state has been returned. Therefore, in S440, both the error number and the light failure flag LF are reset.

On the other hand, if the light failure flag LF is not set to '1' in S370, or if the light failure flag LF is set to '1' in S370 but is reset by the step of S440, the process proceeds to S380 to start time count (time measurement) by the counter 69. In subsequent S390, it is determined whether or not seven seconds or more have elapsed since the start of time measurement in S380. If seven seconds or more have not yet elapsed at this time, the stationary time operation control process is ended. If seven seconds or more have elapsed, the process proceeds to S400 to stop the rotation of the fan motor 29 (stop the battery power supply to the fan motor 29, in detail). Thereafter, in S410, it is determined whether or not seventeen seconds or more have elapsed since the start of the time measurement in S380 (i.e., whether or not ten seconds or more have elapsed from the stop of the power supply to the fan motor 29 in S400). If not, the stationary time operation control process is ended. If seventeen seconds or more have elapsed, the counter 69 is reset and the fan state flag FF is reset to '0' in S420.

The reason why the fan state flag FF is not immediately reset when the power supply to the fan motor 29 is stopped in S400 and is reset when ten seconds or more have elapsed since the stop of the power supply is because the fan 30 does not immediately stop rotation even if the power supply to the fan motor 29 is stopped, and continues to rotate due to inertia for a while (a few seconds). Normally, if ten seconds at most elapses since the power supply to the fan motor 29 is stopped, it is assumed that the rotation of the fan 30 stops. Therefore, in the present embodiment, when ten seconds or more have elapsed since the power supply is stopped (S410: YES), it is determined that the fan 30 has certainly stopped, and the fan state flag FF is reset (S420).

In the determination step of S340, in case that the contact arm state flag AF is set to '1', the process proceeds to S430. The count (time measurement) by the counter 69 is stopped and the count value is reset. Also, the contact arm state flag AF is reset to '0'. It is in a later-described step of S550 (see FIG. 7) that the contact arm state flag AF is set to '1'.

In the determination step of S350, when it is determined that the trigger state flag TF is set to '1', the error number is set to '4' and the heavy failure flag EF is set to '1' in S470, provided that the heavy failure flag EF is not yet set to '1' (S460:NO). That the error number is set to '4' means that the gas nailer 1 is in the failure state "4" (failure state "4-2" in detail) and the failure state has been detected.

More particularly, in case that the operation of driving in a nail has not yet performed, the trigger state flag TF naturally remains reset. If it is negatively determined in S330 (it is determined that the contact arm SW34 is in an off state) even after driving in of a nail has been carried out, the trigger 7 should have been returned after driving and the contact arm 6 should have been returned to its original state. Both the trigger SW 35 and the contact arm SW 34 should be in an off state. In case that the trigger SW 35 is turned into an off state again from an on state as such, the trigger state flag TF has to be already reset to '0' by a later-described step of S650 (see FIG. 7).

In contrast, that it is determined in S350 that the trigger state flag TF is set to '1' means that the trigger SW 35 is in an on state (i.e., the failure states "4-2") for some reason although the contact arm SW 34 is in an off state. Thus, in this case, it is determined that the failure state "4-2" has occurred. Corresponding steps (S460 to S470) are performed.

Also, when the trigger state flag TF is reset (S350: NO) but it is determined that the trigger SW 35 is in an on state in the determination step of S360, the process proceeds to S590 of FIG. 7 and onwards, provided that the heavy failure flag EF is not yet set to '1' (S450: NO). The failure state "5" is detected.

In this case, since the trigger state flag TF is '0', the process proceeds from S590 to S600 in FIG. 7. In S600, the ignition circuit 59 is operated (the ignition power supply signal of H level is outputted to the ignition power supply circuit 56) to make the ignition plug 33 spark. Also, time measurement by the counter 69 is stopped to reset the counter value and the trigger state flag TF is set to '1'. In S610, it is determined whether or not the contact arm state flag AF is '0'. Here, by the step of S340 or S430 (see FIG. 6), the contact arm state flag AF has to be '0'. Thus, the process proceeds to S720 to set the error number to '5' and set the heavy failure flag EF to '1'. That the error number is set to '5' means that the gas nailer 1 is in the failure state "5" and the failure state has been detected. When the error number is set to '5' as such, the indication lamp 45 is lighted in the indication pattern E set corresponding to the error number '5' (failure state "5").

If it is determined in the determination step of S330 in FIG. 6 that the contact arm SW 34 is not in an on state, the contact arm 6 is not pressed against the workpiece material W or the like and should be in the state at normal times. In this case, the trigger 7 is unable to be pulled due to the interlock and the trigger SW 35 should be also in an off state. Nevertheless, it is determined that the trigger SW 35 is in an on state in S360. This is considered that the gas nailer 1 is in the failure state "5". Accordingly, the failure state "5" is detected (the error number is set to '5') in S720 of FIG. 7, provided that the heavy failure flag EF is not yet set to '1' as previously noted.

When it is determined in the determination step of S330 that the contact arm SW 34 is in an on state, the process proceeds to S520 of FIG. 7 and onwards. In S520, it is determined whether or not the heavy failure flag EF is set to '1'. In subsequent S530, it is determined whether or not the light failure flag LF is set to '1'. At this time, if at least one of the failure flags is already set to '1', the stationary time operation control process is ended. Thereafter, until the cause of the failure is removed and recovery from the failure state is attained in both hardware and software aspects, operation of driving in a nail is not performed.

On the other hand, if both the heavy failure flag EF and the light failure flag LF are '0', the process proceeds to S540. In S540, it is determined whether or not the contact arm state flag AF is '0'. In the case of '0', the process proceeds to S550 to stop time measurement by the counter 69 and reset the count value. Also, the contact arm state flag AF is set to '1'. The process proceeds to S560. If the contact arm state flag AF is already set to '1' in the step of S540, the process proceeds to S560.

In S560, it is determined whether or not the fan motor 29 is connected to the control circuit 40 normally. The determination is performed based on the motor connection detection signal from the motor connection detection circuit 55. Here, if it is determined that the fan motor 29 is not connected (not connected normally), the error number is set to '6' and the heavy failure flag EF is set to '1' in S710, provided that the fan state flag FF is not set to '1' (S700: NO).

That the error number is set to '6' means that the gas nailer 1 is in the failure state "6" and the failure state "6" has been detected. If the error number '6' is set as such, the indication lamp 45 is lighted in the indication pattern F set corresponding to the error number '6' (failure state "6"). If the fan state flag FF is set to '1' in the determination step of S700, the process does not proceed to S710 and proceeds to S570.

If it is determined in S560 that the fan motor 29 is connected normally, or it is determined in S560 that the fan motor 29 is not connected but it is determined in S700 that the fan state flag FF is set to '1', the process proceeds to S570 to supply the battery power to the fan motor 29 and operate (rotate) the fan 30. Also, the fan state flag FF is set to '1'.

When it is determined in S560 that the fan motor 29 is not connected but it is determined in S700 that the fan state flag FF is set to '1', the gas nailer 1 is not in the failure state. More particularly, even if the battery power supply to the fan motor 29 is stopped to stop the rotation of the fan motor 29, the fan motor 29 does not immediately stop the rotation due to inertia of the fan motor 29 and the fan 30, as noted above. Accordingly, even after the battery power supply to the fan motor 29 is stopped, the detection transistor Tr3 of the motor connection detection circuit 55 is not turned on as long as the fan motor 29 continues to rotate, because of a back electromotive force generated inside the fan motor 29 by the rotation. Thus, the motor connection detection signal of L level (i.e., the signal indicating that the fan motor 29 is not connected normally) is supplied to the microcomputer 61.

In this manner, as long as the fan motor 29 rotates although the fan motor 29 is connected to the control circuit 40 normally, it is mistakenly detected that the fan motor 29 is not connected because of the back electromotive force generated by the rotation. Thus, if it is determined in S700 that the fan state flag FF is set to '1' even if it is determined in S560 that the fan motor is not connected, it is determined that the determination result in S560 is caused because the fan motor 29 is not yet stopped and that the fan motor 29 is connected normally. The process proceeds to S570.

When the power supply to the fan motor 29 is started and the fan 30 starts to operate in S570, it is determined in subsequent S580 whether or not the trigger SW 35 is turned on. Here, if the trigger SW 35 is turned on, the process proceeds to S600, provided that the trigger state flag TF is still '0' (S590: YES). In S600, as previously noted, the ignition circuit 59 is operated to make the ignition plug 33 spark, time measurement by the counter 69 is stopped to reset the counter value, and the trigger state flag TF is set to '1'. If the trigger state flag TF is already set to '1' in the determination step of S590, the process does not proceed to S600 and proceeds to S610.

In the determination step of S610, if the contact arm state flag AF is '0', the process proceeds to S720 as previously noted. If the contact arm state flag AF is set to '1' (normally, should be set to '1' by the step of S550), time measurement by the counter 69 is executed in S615. In S620, it is determined whether or not five seconds or more have elapsed from the start of time measurement. If five seconds or more have not elapsed, the stationary time operation control process is ended. If five seconds or more have elapsed, that is, if the state in which both the contact arm SW 34 and the trigger SW 35 are in an on state has continued for five seconds or more, the process proceeds to S630.

In S630, time measurement by the counter 69 is stopped to reset the counter value of the counter 69. Also, the error number is set to '3' and the light failure flag LF is set to '1'. That the error number is set to '3' means that the gas nailer 1 is in the failure state "3" and the failure state "3" has been detected. If the error number '3' is set as such, the indication lamp 45 is lighted in the indication pattern C set corresponding to the error number '3' (failure state "3"). In subsequent S640, the battery power supply to the fan motor 29 is stopped.

On the other hand, when it is determined in S580 that the trigger SW 35 is not in an on state (i.e., the trigger 7 is not pulled), the process proceeds to S650 to stop time measurement by the counter 69 and reset the count value. Also, the trigger state flag TF is reset to '0'. In S660, time measurement by the counter 69 is carried out. In subsequent S670, it is determined whether or not five seconds or more have elapsed from the start of the time measurement. If five seconds or more have not elapsed, the stationary time operation control process is ended. If five seconds or more have elapsed, that is, in case that the state in which the contact arm SW 34 is turned on and the trigger SW 35 is turned off continues for five seconds or more, the process proceeds to S680.

In S680, stopping/resetting the counter 69 and setting the light failure flag LF to '1' are carried out, as in the case of S630. Also, the error number is set to '2'. That the error number is set to '2' means that the gas nailer 1 is in the failure state '2' and the failure state '2' has been detected. When the error number '2' is set as such, the indication lamp 45 is lighted in the indication pattern B set corresponding to the error number '2' (failure state "2"). In subsequent S690, the battery power supply to the fan motor 29 is stopped.

(5) Effect of the First Embodiment

As described in the above in detail, the gas nailer 1 of the present embodiment is configured to be able to detect the eight kinds of preset failure states "1" to "8" in the control circuit 40. The different indication patterns A to H are set corresponding to the respective failure states "1" to "8". If one of the failure states is detected, the indication lamp 45 (the three LEDs 46, 47 and 48) operates in the indication pattern corresponding to the detected failure state.

According to the gas nailer 1 of the present embodiment, if one of the failure states "1" to "8" occurs, the users are able to promptly grasp which failure state has occurred by looking at the indication (indication pattern) of the indication lamp 45. Appropriate measures can be promptly taken to the occurred failure.

Moreover, almost all the failure states which may possibly occur in the gas nailer 1 are set as the failure states "1" to "8". Thus, almost all the failure states which may occur can be detected. The users can particularly and promptly grasp which kind of the failure state has occurred.

Particularly, presence/absence of the failure states "1" and "4-1" is firstly determined upon attachment of the battery 11. If occurrence of either of the failure states is detected, indication is provided in the indication pattern A or D corresponding to the detected failure state. Accordingly, the users can first recognize presence/absence of the failure states "1" and "4-1" immediately after attachment of the battery 11. In the case of failure, measures can be taken to the failure right away.

Also, even if neither of the failure states "1" nor "4-1" is detected upon attachment of the battery 11, it is possible that the contact arm SW 34 may remain in an on state for some reason thereafter. In the present embodiment, if the contact arm SW 34 may remain in an on state, such state can be detected as the failure state "2" or "3".

Also, when the failure state "6" occurs in which the fan motor 29 and the control circuit 40 are not electrically connected normally, the fan 30 may rotate in an insufficient mariner or may not rotate at all. Incomplete combustion of the fuel gas may occur inside the combustion chamber. In the present embodiment, if the failure state "6" occurs, the failure state is detected and indication is provided in the corresponding indication pattern F. Thus, the users can promptly recognize occurrence of the failure state "6". Adverse effect can be inhibited such as incomplete combustion which is caused because the fan 30 does not rotate normally.

Also, when the failure state "7" occurs in which the battery power is supplied to the ignition circuit 59 at all times, the ignition circuit 59 may operate regardless of the operation of the trigger 7 and the ignition plug 33 may spark unnecessarily. In the present embodiment, if the failure state "7" occurs, the failure state is detected and indication is provided in the corresponding indication pattern G. Thus, the users can promptly recognize occurrence of the failure state "7". Adverse effect can be inhibited such as unnecessary spark of the ignition plug 33.

Also, the gas nailer 1 of the present embodiment includes the interlock mechanism. The interlock mechanism may be damaged for some reason. In the present embodiment, the failure state (failure states "4-2" and "5", for example) expected to be caused by damage of the interlock mechanism can be also detected. Indication is provided in the indication pattern corresponding to the failure state. Thus, when the failure state occurs in which one of the causes of the failure may be damage in the interlock mechanism, the users can promptly recognize the occurrence of the failure.

In the present embodiment, the contact arm 6 corresponds to a press member of the present invention. The contact arm SW 34 corresponds to a press detection switch of the present invention. The trigger 7 corresponds to an operation member of the present invention. The trigger SW 35 corresponds to an operation detection switch of the present invention. The microcomputer 61 corresponds to an operation state detector of the present invention. The counter 69 corresponds to a timer of the present invention. The cylinder 15, the piston 16 and the driver blade 17 constitute a power transmitter of the present invention. The microcomputer 61 and the indication circuit 60 constitute a report unit (light emitter) of the present invention.

Second Embodiment

In the present embodiment, a gas nailer will be described which has the same configuration/function as the gas nailer 1 of the above-described first embodiment, and further has a function (regular maintenance time report function) to detect arrival of the time for regular maintenance and report the arrival to the outside (to the users).

Here, necessity of the regular maintenance in the gas nailer will be schematically explained. The gas nailer is a tool to ignite and explode fuel gas to drive in a nail. The mechanism and the working principle of the gas nailer are similar to those of an internal combustion (gasoline engine) of an automobile. Accordingly, if the tool is continued to be used, the respective electrodes 33*a* and 33*b* of the ignition plug 33 may get dirty or oxidation may occur. Thus, it is necessary to check up the ignition plug 33 regularly to remove the dirt, or replace the ignition plug 33 with a new one, depending on the degree of wear. Other than the regular check up of the ignition plug 33, the tool requires much regular maintenance to be performed such as check up, part replacement, cleaning, etc. of the internal mechanism, mainly the cylinder 15 and the piston 16, and the interlock mechanism.

Normally, the above-described regular maintenance is difficult to be performed by the user itself. Thus, in general, when to perform regular maintenance (for example, per a few months, per several tens of thousands of times of nail driving operation, etc.) is described in the manual so that the users are reminded to have the gas nailer maintained upon arrival of such time. The users are required to manage the use state of the tool (used days, used number of times, etc.) and have the tool receive regular maintenance upon arrival of predetermined timings.

However, it is very troublesome for the user itself who uses the gas nailer to grasp the timings for regular maintenance. It is hardly said that such timings are sufficiently managed. Therefore, in practice, there are many cases where the tool is continued to be used as long as the operation of driving in a nail can be performed without problem. When normal driving is no longer performed due to a failure and so on, the tool is sent out for maintenance. In that case, the operation of driving in a nail may be suddenly disabled. Moreover, other operation pertaining to the driving operation may have to be interrupted. Various adverse effects may occur on the user side.

The gas nailer of the present embodiment includes the regular maintenance time report function and by itself reports to the users the arrival of the time for regular maintenance. Particularly, the number of times of the operation of driving in a nail (the number of times of ignition of the ignition plug 33) is counted. When the counted number reaches a predetermined number, the gas nailer reports the fact (i.e., that the time for regular maintenance has arrived) to the user.

Figure 8:
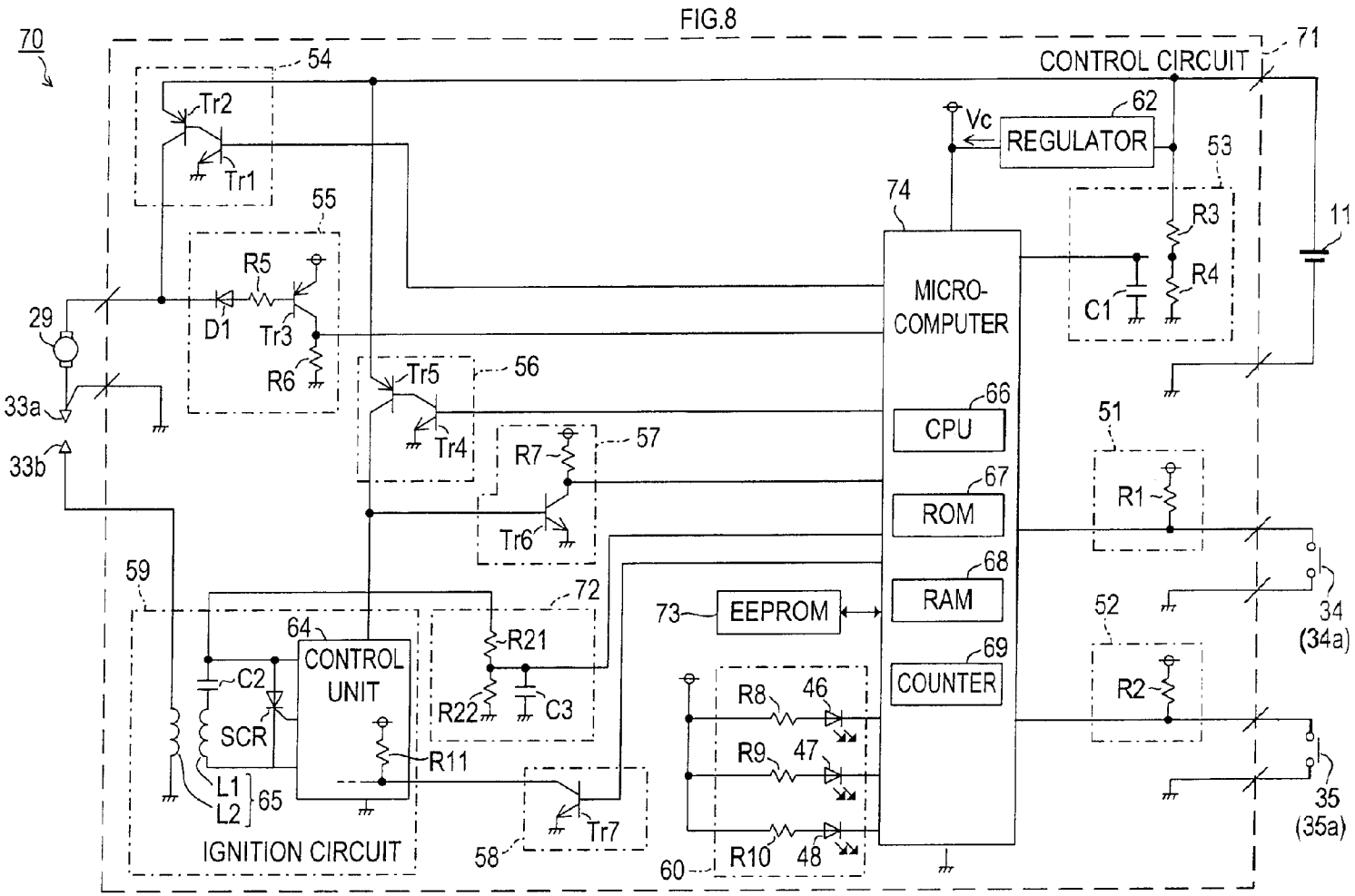
FIG. 8 is a circuit diagram showing a control circuit provided in the gas nailer according to the second embodiment.

As compared with the gas nailer 1 of the first embodiment, the gas nailer of the present embodiment including the regular maintenance time report function has the same constitution as the gas nailer 1 of the first embodiment shown in FIGS. 1 and 2, except that the structure of the control circuit is partially different from the control circuit 40 of the gas nailer 1. Thus, in the following description, description of the same component as that in the first embodiment will not be repeated, and the components different from those of the gas nailer 1 of the first embodiment (structure of the control circuit) will be described. FIG. 8 is a circuit diagram showing an electrical configuration of a control circuit 71 provided in a gas nailer 70 of the present embodiment.

As shown in FIG. 8, the control circuit 71 inside the gas nailer 70 of the present embodiment has the configuration of the control circuit 40 inside the gas nailer 1 of the first embodiment (see FIG. 3) and further includes a charging voltage detection circuit 72 and an EEPROM-73. Also, a microcomputer 74 executes the drive operation control process (see FIGS. 4 to 7) in the same manner as the microcomputer 61 of the first embodiment. Moreover, the microcomputer 74 executes a regular maintenance time report process for achieving the above-described regular maintenance time report function.

The charging voltage detection circuit 72 provided in the control circuit 71 is a circuit for detecting a charging voltage of the charging capacitor C2 inside the ignition circuit 59. Basically, the charging voltage detection circuit 72 is configured the same as the battery voltage detection circuit 53. More particularly, the charging voltage detection circuit 72 includes two voltage dividing resistors R21 and R22 and a capacitor C3. The voltage dividing resistors R21 and R22 divide the charging voltage of the charging capacitor C2 at a predetermined voltage dividing ratio. The capacitor C3 absorbs fluctuation of a voltage dividing value divided by the voltage dividing resistors R21 and R22 and supplies the stabilized voltage dividing value (analog battery voltage signal) to the microcomputer 74. With such configuration, the charging voltage signal having a value corresponding to the charging voltage of the charging capacitor C2 is supplied from the charging voltage detection circuit 72 to the microcomputer 74.

The microcomputer 74 determines whether or not the charging voltage value of the charging capacitor C2 has reached a predetermined level based on the charging voltage signal from the charging voltage detection circuit 72. As previously noted, when the operation of the ignition circuit 59 is started, the charging capacitor C2 is charged up to a predetermined high voltage. Thus, the level of the charging voltage signal supplied from the charging voltage detection circuit 72 to the microcomputer 74 as well is gradually increased, following the charging. The microcomputer 74 determines whether or not the supplied charging voltage signal is equal to or larger than a predetermined charging voltage determination threshold. When it is determined that the charging voltage signal is equal to or larger than the charging voltage determination threshold, it is determined that the ignition plug 33 has sparked.

The charging voltage determination threshold is a value which is not reached at normal times when the ignition circuit 59 does not operate, and which is sufficiently reached and exceeded when the ignition circuit 59 operates for ignition of the ignition plug 33 and the charging capacitor C2 is charged to the predetermined high voltage (high voltage required for sparking). In other words, that the charging voltage signal is equal to or larger than the charging voltage determination threshold indicates that the high voltage necessary for the ignition plug 33 to spark is charged to the charging capacitor C2, and further indicates that the ignition plug 33 sparks with the high voltage. Accordingly, if it is determined that the charging voltage signal is equal to or larger than the charging voltage determination threshold, it can be determined that the ignition plug 33 has sparked and driving in of a nail has carried out once.

In this manner, each time the charging voltage signal from the charging voltage detection circuit 72 becomes equal to or larger than the charging voltage determination threshold, the microcomputer 74 determines that driving in of a nail has been executed once. The microcomputer 74 counts the number of times in an accumulated manner and stores in the EEPROM 73 the number of times of ignition which is the count value. Accordingly, the count value (the number of times of ignition) stored in the EEPROM 73 is incremented by one each time the charging voltage signal becomes equal to or larger than the charging voltage determination threshold.

When the number of times of ignition is equal to or larger than a predetermined ignition times determination threshold, it is determined that the time for regular maintenance has arrived, and the fact is reported. The reporting is carried out by the indication lamp 45 including the three LEDs 46, 47 and 48. The indication lamp 45 is lighted in an indication pattern which is different from the respective indication patterns A to H corresponding to the failure states "1" to "8" in the first embodiment and which can make the users who look visually understand that the time for regular maintenance has arrived. The ignition times determination threshold may be arbitrarily determined depending on the number of times of ignition (the number of times of driving in of a nail) required for regular maintenance.

Figure 9:
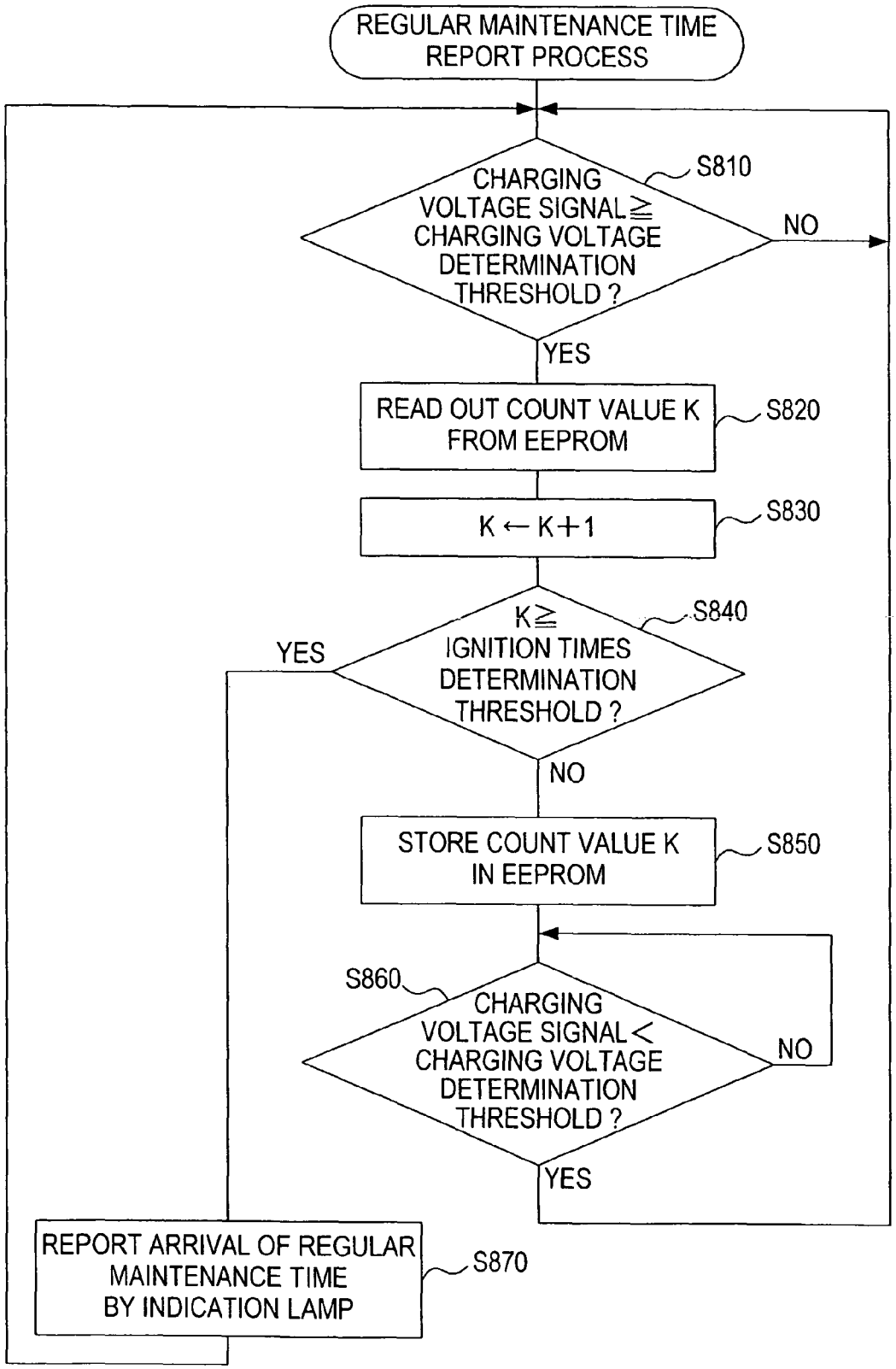
FIG. 9 is a flowchart illustrating a regular maintenance time report process executed in the control circuit according to the second embodiment.

FIG. 9 shows a flowchart of the regular maintenance time report process executed by the microcomputer 74 in order to achieve the above-described regular maintenance time report function. The microcomputer 74 of the present embodiment executes the regular maintenance time report process shown in FIG. 9 in parallel (e.g., as a multitask process) with the drive operation control process described in the first embodiment (FIGS. 4 to 7).

When the regular maintenance time report process is started, it is firstly determined in S810 whether or not the charging voltage signal from the charging voltage detection circuit 72 is equal to or larger than the charging voltage determination threshold. If it is determined that charging voltage signal from the charging voltage detection circuit 72 is equal to or larger than the charging voltage determination threshold, the process proceeds to S820.

In S820, a count value K is read out from the EEPROM 73. In subsequent S830, the count value K is incremented. In S840, it is determined whether or not the count value K is equal to or larger than the ignition times determination threshold.

If it is determined in the determination of S840 that the count value K is not yet equal to or larger than the ignition times determination threshold, the count value K is stored in the EEPROM 73 in S850. Thereby, the count value K stored till then is updated by the newly stored count value K. It is then determined in S860 whether or not the charging voltage signal becomes smaller than the charging voltage determination threshold. If it is determined that the charging voltage signal becomes smaller, the process returns to the step of S810 again.

As above, each time charging voltage signal becomes equal to or larger than the charging voltage determination threshold, the count value K is incremented. When the count value K becomes equal to or larger than the ignition times determination threshold (S840: YES), the process proceeds to S870. The indication lamp 45 is lighted in the indication pattern which indicates that the time for regular maintenance has arrived thereby to report to the users that the time for regular maintenance has arrived.

After the regular maintenance, it is necessary to initialize the count value K stored in the EEPROM 73 to '0' again. Various manners of initialization are assumed. For example, the microcomputer 74 may initialize the count value K in case that a specific sequence operation is performed which seldom occurs during normal use of the gas nailer 70. An example of such specific sequence operation may be to perform a series of operations within a predetermined time by a predetermined number of times, such as pressing the contact arm 6 (turning on the contact arm SW 34) in a state in which the fuel gas can is not loaded into the gas nailer 70 (i.e., a state in which the fuel gas is not supplied into the combustion chamber), pulling the trigger 7 for a predetermined number of times (turning on the trigger SW 35 for a predetermined number of times), and then returning the trigger 7 and the contact arm 6 to their original positions. This is of course merely an example. It is possible to arbitrarily set any operation which is vanishingly improbable to be performed during the normal operation.

Also, the gas nailer 70 can be used even after the count value K becomes equal to or larger than the ignition times determination threshold and the reporting by the indication lamp 45 is performed. To put it the other way around, the ignition times determination threshold is defined such that the gas nailer 70 is not disabled right after the reporting to the users that the time for regular maintenance has arrived, but can be used for a while.

As described in the above, in the gas nailer 70 of the present embodiment, the microcomputer 74 counts the number of times of ignition (number of times of operations of driving in of a nail) based on the charging voltage of the charging capacitor C2 inside the ignition circuit 59. When the count value K becomes equal to or larger than the predetermined ignition times determination threshold, it is reported to the users that the time for regular maintenance has arrived. The reporting is carried out by indication by (lighting/blinking of) the three LEDs 46, 47 and 48 constituting the indication lamp 45 in the predetermined indication pattern (different from the already described indication patterns A to H). More particularly, the gas nailer 70 itself detects that the time for regular maintenance has arrived and reports the fact thereby to urge the users to have the regular maintenance done.

According to the gas nailer 70 of the present embodiment, the users are able to recognize that the time for regular maintenance has arrived through the indication lamp 45 in a reliable manner. Therefore, there is no necessity for the users themselves to mind the time for regular maintenance. The convenient gas nailer 70 can be provided. When the time for regular maintenance has arrived, the gas nailer 70 can be promptly sent out for regular maintenance.

In the regular maintenance time report process of FIG. 9, the steps of S810 to S830 correspond to a process executed by an ejection times counter of the present invention. The step of S840 corresponds to a process executed by an ejection times determiner of the present invention. The step of S870 corresponds to a process executed by an operation state detector (claim 9) of the present invention.

[Variations]

The embodiments of the present invention have been described in the above. However, it goes without saying that the embodiments of the present invention are not limited to the above-described embodiments, and can take various modes as long as such modes belong to the technical scope of the present invention.

For example, in the above-described first embodiment, the eight kinds of failure states "1" to "8" are defined as the failure states which may possibly occur in the gas nailer 1. This is merely an example. Less kinds of failure states may be defined or, to the contrary, more kinds of failure states may be defined.

Also in the above-described embodiments, it is described that the electrical connection between the control circuit 40, and the respective SWs 34 and 35, the battery 11 and the fan motor 29 (hereinafter, referred to as a "connected target", respectively) is made via the two substrate side connectors 43 and 44 on the substrate 41. Particularly, as shown in FIG. 10A, a connected target side connector 103 which is a connector to be fitted to the one substrate side connector 44 is connected to a front end (on the control circuit 40 side) of a power line 104 laid from a connected target to the control circuit 40. Accordingly, when the connected target side connector 103 and the substrate side connector 44 are fitted to each other, the control circuit 40 and the connected target are electrically connected. To the other substrate side connector 43, the connected target side connector is fitted in the same manner, and the control circuit 40 and the connected target are electrically connected, although not shown.

In the configuration shown in FIG. 10A, contact failure between the interfitted connectors may occur due to use of the gas nailer 1 over time. Since the operation of the gas nailer 1 is to explode fuel gas and drive in a nail by the pressure of the explosion, an impact upon the operation is high. Thus, each time the operation of driving in of a nail (ignition/explosion) is carried out, the fitted portion (portion indicated as a symbol 'A' in the figure) between the respective connectors 44 and 103 is moved by the impact and then the contact portion is worn out. This is because, while a pin (not shown) of the substrate side connector 44 is secured to the substrate 41, a contact (not shown) of the connected target side connector 103 connected to the power line 104 is movable. Each time the operation of driving in of a nail is carried out, the fitted portion between the connectors 44 and 103 has to bear the brunt of the impact.

Figure 10B:
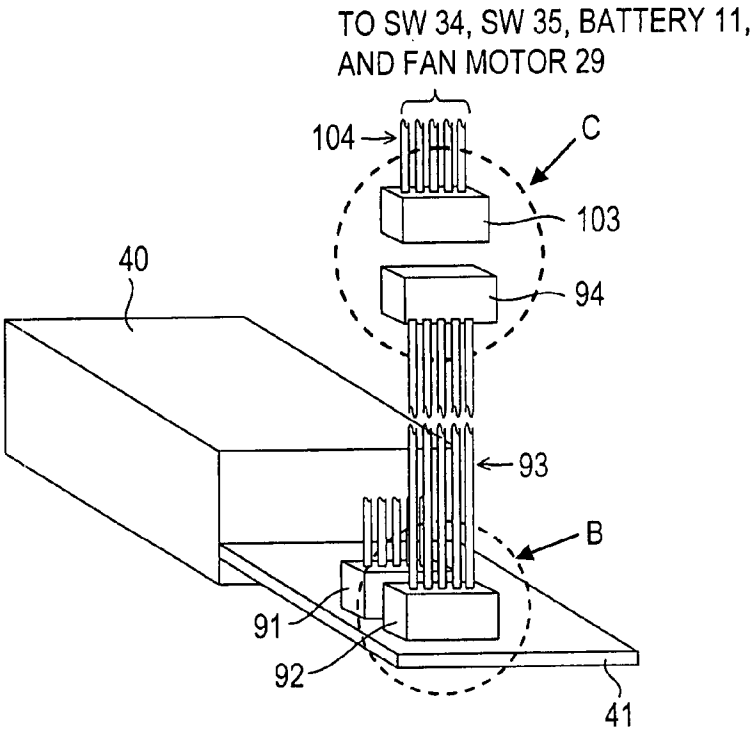
FIGS. 10A and 10B are explanatory views showing particular configuration of a connector which electrically connects the control circuit and an object to be connected.
Figure 10A:
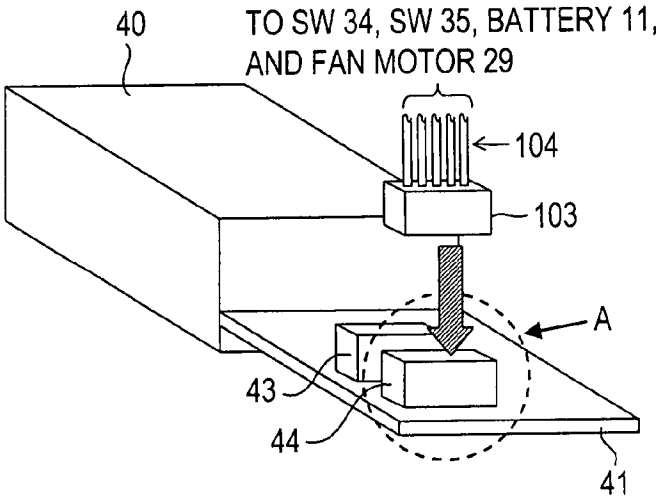

For example, a configuration as shown in FIG. 10B can attenuate the impact to the interfitted connectors and make it difficult for electric contact failure to occur (or eliminate electric contact failure).

In the configuration shown in FIG. 10B, board-in connectors 91 and 92 are provided on the substrate 41, instead of the substrate side connectors 43 and 44 shown in FIG. 10A. A lead wire 93 is drawn from the one board-in connector 92 (a symbol 'B' in the figure). The lead wire 93 is directly connected to the substrate 41 via the board-in connector 92. Alternatively, the lead wire 93 may be directly drawn from the substrate 41 without using the board-in connector 92.

A relay side connector 94 is connected to an end portion opposite to the substrate 41 side of the lead wire 93. When the relay side connector 94 is fitted to the connected target side connector 103, electrical connection is achieved between the power line 104 on the connected target side and the lead wire 93 (and electrical connection between the connected target and the control circuit 40; a symbol 'C' in the figure).

As noted above, in the configuration shown in FIG. 10B, the connectors are not fitted on the substrate 41, but the lead wire 93 is drawn from the substrate 41. The relay side connector 94 is connected to the lead wire 93, and the relay side connector 94 and the connected target side connector 103 are fitted to each other. More particularly, the respective connectors 94 and 103 which are not provided in a secured manner can be moved within a predetermined range even in an interfitted state. Therefore, most of the impact upon the operation of driving in of a nail is absorbed into the lead wire 93. Influence on the fitted portion between the connectors 94 and 103 can be largely suppressed. Accordingly, the fitted portion between the respective connectors 94 and 103 (contact portion between the pin and the contact) can be inhibited from being worn out. Electrical connection between the connectors 94 and 103 can be maintained in a favorable manner. Although not shown, the other board-in connector 91 has the same configuration as the above-described board-in connector 92.

Also in the above embodiments, the failure state "6" is described as a state in which the fan motor 29 and the control circuit 40 are not electrically connected. The failure state "6" does not merely represent the state in which the fan motor 29 and the control circuit 40 are not electrically connected, but, for example, can include disconnection of a coil (winding) inside the fan motor 29. More particularly, various failures which disable the operation (rotation) of the fan motor 29 although the control circuit 40 is normal and which can be detected based on the motor connection detection signal from the motor connection detection circuit 55 may be defined as the failure state "6" in general.

Moreover, a failure in which a motor wiring causes short-circuit may occur with respect to the fan motor 29, for example. Therefore, the gas nailer may be configured such that all failures, other than the failure state "6", are able to be detected which do not allow normal rotation of the fan motor 29, such as the above-noted short-circuit in a motor wiring. Also, the indication lamp 45 may be lighted in a specific indication pattern corresponding to the kind of the detected failure.

Also in the above-described second embodiment, the number of times of operation of driving in a nail is counted based on the number of times of ignition of the ignition plug 33, more particularly the number of times when the charging voltage signal from the charging voltage detection circuit 72 becomes equal to or larger than the charging voltage determination threshold. Based on the count value K, arrival of the time for regular maintenance is reported. This is merely an example. How the number of times of operation of driving in a nail is detected and counted can take other various manners.

For example, when a predetermined high voltage is, charged to the charging capacitor C2 and the discharge thyrister SCR is turned on, the charged electric charge of the charging capacitor C2 is rapidly discharged. The charging voltage rapidly decreases. Therefore, by detecting the discharge (decrease in voltage), the number of times of ignition (the number of times of driving in a nail) may be counted as once.

Also for example, the number of times of ignition may be counted as once when it is detected that the charging voltage signal becomes equal to or larger than the charging voltage determination threshold and thereafter becomes smaller than the charging voltage determination threshold again. Also for example, the number of times of the trigger 7 being pulled, that is, the number of times of the trigger SW 35 being turned on, may be counted as once.

Also in the above-described embodiments, it is described that the different colors of light are emitted from the respective LEDs 46, 47 and 48 constituting the indication lamp 45. This is not mandatory. For example, two of the LEDs may emit the same color of light. Also for example, all the LEDs may emit the same color of light. In that case, the lighting time and the lighting timing of the respective LEDs may be properly defined so that lighting is controlled according to the types of failure. Also, providing three LEDs is only an example. As long as different indication patterns can be generated according to the kind of failure, there is no specific limitation to the number of LEDs.

Moreover, in case that a plurality of failure states occur, the indication lamp 45 (indication circuit 60) may be configured to be able to offer indications corresponding to the respective failure states simultaneously or sequentially one by one. More particularly, for example, the indication lamp 45 may be configured to be able to indicate all the failure states which have occurred and have been detected, or only all the detected heavy failures. Also in the second embodiment, detection of one or a plurality of failure states and arrival of the time for regular maintenance may be indicated simultaneously or sequentially one by one through the indication lamp 45. Various particular configurations of the indication circuit 60 can be assumed for achieving such indication. The larger number of LEDs may be used, or the number of LEDs used may be limited by varying the indication patterns. In the former case, for example, eight LEDs may be provided for reporting the failure states "1" to "8" and a further LED may be provided for reporting the state in which the time for regular maintenance has arrived. When one of the states occurs, the corresponding LED can be lighted.

Furthermore, the indication that the failure states "1" to "8" has occurred in the above-described first embodiment and the reporting that the time for regular maintenance has arrived in the above-described second embodiment are not limited to visual reporting through the indication lamp 45 but may be reported, for example, by sound. Of course, visual reporting through the indication lamp 45 and auditory reporting by sound may be combined. As long as the user or the repair person can easily understand (discern) that a failure has occurred and the kind of failure or arrival of the time for regular maintenance, there is no specific limitation to particular manners of reporting.

Also in the above-described embodiments, examples are provided in which the present invention is applied to a gas nailer (gas combustion type drive tool). The present invention is not limited to a gas nailer, and can be applied, for example, to an air type drive tool in which a fastening tool such as a nail is driven in by air pressure.

What is claimed is:

1. A drive tool comprising:

an ejector that ejects a fastening tool to an object to drive the fastening tool into the object, a press member that is pressed against the object at one end to be moved, a press detection switch that is turned on when the press member is pressed against the object, an operation member that is operated when the fastening tool is ejected to the object, an operation detection switch that is turned on when the operation member is operated, a control unit that receives power supply from a battery to operate and makes the ejector carry out ejection of the fastening tool when both the press detection switch and the operation detection switch are turned on, an operation state detector that detects a case where the drive tool comes into one of a plurality of kinds of preset operation states which include at least one operation state other than a state of the battery, and a report unit in which report patterns different for each of the plurality of kinds of operation states are set, and which, when one of the operation states is detected by the operation state detector, reports the detection using the report pattern set corresponding to the detected operation state.

2. The drive tool according to claim 1 wherein at least a plurality of kinds of failure states which possibly occur in the drive tool are preset as the plurality of kinds of operation states.

3. The drive tool according to claim 2 wherein the ejector includes:

a combustion chamber to which fuel gas is supplied when the press member is moved, a fan that stirs inside the combustion chamber the fuel gas supplied into the combustion chamber, a motor that receives power supply from the battery to operate and rotates the fan when the press detection switch is turned on, an igniter that receives power supply from the battery to operate and ignites and burns the fuel gas inside the combustion chamber when the operation detection switch is turned on, and a power transmitter that transmits to the fastening tool a pressure generated when the fuel gas is burned by the igniter as a power for the ejection, wherein a first failure state is set, as one of the failure states, which indicates that electrical connection is not normal between the motor and a connected object electrically connected to the motor, and the operation state detector determines whether or not the electrical connection is normal between the motor and the connected object, and, based on a determination result, detects the first failure state.

4. The drive tool according to claim 3, wherein the igniter is configured such that the power supply from the battery is stopped when the operation detection switch is not turned on, a second failure state is set, as one of the failure states, which indicates that the power from the battery is supplied to the igniter when the operation detection switch is not turned on, and the operation state detector detects the second failure state based on a state of the operation detection switch and a state of the power supply from the battery to the igniter.

5. The drive tool according to claim 2, wherein at least one of a third failure state which indicates that the press detection switch is already turned on when the power supply from the battery to the control unit is started, and a fourth failure state which indicates that the operation detection switch is already turned on when the power supply from the battery to the control unit is started, is set as the failure state, the operation state detector detects at least one of the third failure state and the fourth failure state set based on one of a state of the press detection switch and a state of the operation detection switch immediately after the power supply from the battery to the control unit is started.

6. The drive tool according to claim 2, wherein a fifth failure state is set as one of the failure states which indicates that the press detection switch has been turned on for a period of time equal to or more than a predetermined period of time, the operation state detector includes a timer that times the period during which the press detection switch is turned on, and detects the fifth failure state based on a timing result by the timer.

7. The drive tool according to claim 2, comprising:

an interlock mechanism that is a mechanism which disables operation of the operation member unless the press member is moved and which, after the operation member is operated in a state in which the press member is moved, keeps the moved press member from returning to its original position unless the operation member returns to its original state before the operation, wherein a sixth failure state is set, as one of the failure states, which indicates a state in which the operation detection switch is turned on when the press detection switch is turned off, and the operation state detector detects the sixth failure state based on the states of the press detection switch and the operation detection switch.

8. The drive tool according to claim 1, wherein at least a check required state which is a state in which the time to check the drive tool has arrived is preset as the operation state.

9. The drive tool according to claim 8, wherein the operation state detector includes an ejection times counter that counts a number of times of ejection of the fastening tool by the ejector and an ejection times determiner that determines whether or not the number counted by the ejection times counter becomes equal to or more than a predetermined ejection times determining threshold, and, wherein when it is determined by the ejection times determiner that the counted number becomes equal to or more than the ejection times determining threshold, the operation state detector detects that the drive tool is in the check required state.

10. The drive tool according to claim 1, wherein the report unit includes at least one light emitter that emits light of a certain color, and reporting is performed by making the light emitter emit light using different emitting patterns per each of the plurality of kinds of operation states as the report patterns.

* * * * *